US008065111B1

(12) United States Patent
Gonzalez

(10) Patent No.: US 8,065,111 B1
(45) Date of Patent: Nov. 22, 2011

(54) SYSTEMS AND METHODS FOR OPTIMIZATION OF MISSILE AND PROJECTILE AERODYNAMIC CONFIGURATIONS

(75) Inventor: David R. Gonzalez, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 532 days.

(21) Appl. No.: 12/319,914

(22) Filed: Dec. 22, 2008

(51) Int. Cl.
*G06F 19/00* (2006.01)

(52) U.S. Cl. ..... 702/182

(58) Field of Classification Search ..... 702/182–185
See application file for complete search history.

(56) References Cited

U.S. PATENT DOCUMENTS

2010/0004769 A1* 1/2010 Holden et al. ..... 700/97
* cited by examiner

*Primary Examiner* — Edward Raymond
(74) *Attorney, Agent, or Firm* — Fredric J. Zimmerman

(57) ABSTRACT

The present disclosure provides systems and methods to aid engineers and designers in pinpointing optimal aerodynamic designs given a target objective. Advantageously, the present invention allows a user to tackle shifts in requirements or to simply conduct preliminary design feasibilities, quickly and efficiently. The present invention includes: (1) a genetic algorithm-based optimizing routine; (2) an existing semi-empirical, aeropredictive code (APC); and (3) an interface between the two. The present invention defines bounds for an array of variables that define the overall aerodynamic geometry and performance measures of a device. The genetic algorithm-based optimizing routine interfaces with the APC to determine a design that best fits the requirements.

21 Claims, 14 Drawing Sheets

| Geometric Parameter | Variable Bounds | Optimization Results |
|---|---|---|
| Nose Length | $0.5 \leq L_n \leq 1.5$ | 1.088 |
| Nose Diameter | $0.4 \leq D_n \leq 1.0$ | 0.894 |
| Centerbody Length | $5.0 \leq L_{cb} \leq 10.0$ | 9.370 |
| Aftbody Length | $0.5 \leq L_{ab} \leq 2.0$ | 2.000 |
| Aftbody Diameter | $0.25 \leq D_{ab} \leq 2.0$ | 1.653 |

| Geometric Parameter | Variable Bounds | Optimization Results |
|---|---|---|
| Nose Length | $0.5 \leq L_n \leq 1.5$ | 0.796 |
| Nose Diameter | $0.4 \leq D_n \leq 1.0$ | 0.770 |
| Centerbody Length | $5.0 \leq L_{cb} \leq 10.0$ | 8.562 |
| Aftbody Length | $0.5 \leq L_{ab} \leq 2.0$ | 1.287 |
| Aftbody Diameter | $0.25 \leq D_{ab} \leq 2.0$ | 0.887 |

FIG. 11a
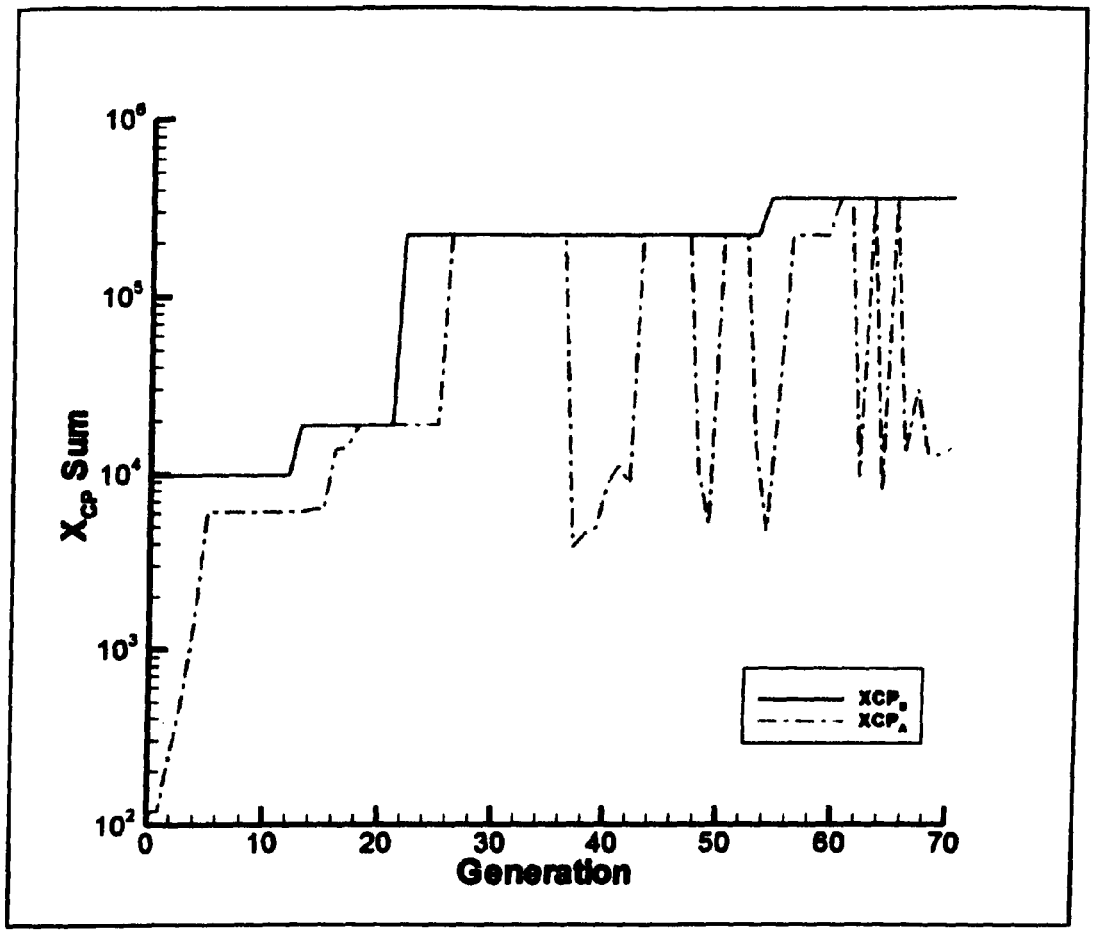
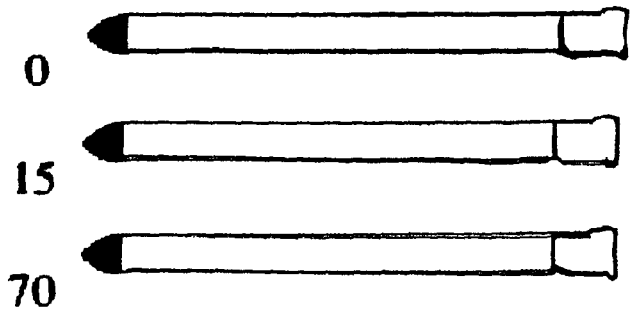
FIG. 11b

| Geometric Parameter | Variable Bounds | Original Design | Optimization Results |
|---|---|---|---|
| Nose Length | $4.0 \le L_n \le 5.5$ | 4.000 | 4.900 |
| Nose Diameter | $4.0 \le D_n \le 4.5$ | 4.000 | 4.000 |
| Centerbody Length | $11.5 \le L_{cb} \le 15.0$ | 11.500 | 12.500 |
| Aftbody Length | $1.5 \le L_{ab} \le 5.0$ | 1.900 | 2.600 |
| Aftbody Diameter | $2.0 \le D_{ab} \le 14.0$ | 5.100 | 6.800 |

SYSTEMS AND METHODS FOR OPTIMIZATION OF MISSILE AND PROJECTILE AERODYNAMIC CONFIGURATIONS

STATEMENT OF GOVERNMENT INTEREST

The present invention described herein may be manufactured and used by or for the Government of the United States of America for government purposes without the payment of any royalties thereon or therefor.

FIELD OF THE INVENTION

The present invention relates generally to aerodynamic optimization systems and methods. More particularly, the present invention provides systems and methods to aid engineers and designers in pinpointing optimal conventional aerodynamic designs given a target objective utilizing a genetic algorithm-based optimizing routine, an aeropredictive code (APC), and an interface between the two.

BACKGROUND OF THE INVENTION

The design of aerospace systems such as missiles and other projectiles relies heavily on the identification of system requirements early on in the development process. Having these firmly defined at an early stage gives engineers the capability of rapidly identifying configurations suitable for the required missions to begin the detailed, evolutionary design process. Aerospace systems require a careful balance between performance and mission objective. This balance forces designers to continuously trade off different aspects of the system to attain the best, most cost effective alternative. However, it is not uncommon for system requirements to shift, or even not to be fully identified, during the initial phases of a program. Depending on the complexity of the system, these setbacks could prove costly, both budget- and schedule-wise.

Most design efforts rely on trial-and-error approaches that leverage well-known trends and are often too general for the application of interest. This process can be quite lengthy and the end results are highly dependent on the designer's experience. For example, aerodynamic platforms such as missiles include numerous components that greatly affect performance in a nonlinear manner. Changes in a single component can potentially destabilize a previously aerodynamically-stable missile. Therefore, trial-and-error approaches may not be the most adequate for the problem at hand, as they may not result in the best-fit solution or be very effective or cost-efficient.

Moore et al., U.S. Pat. No. 6,721,682 issued Apr. 13, 2004, the contents of which are herein incorporated by reference, describe an improved aeroprediction code (APC) that allows aerodynamics to be predicted for Mach numbers up to 20 for configurations with flares. Moreover, the improved APC advantageously extends the static aerodynamic predictions for Mach numbers less than 1.2, improves the body alone pitch damping for Mach numbers above 2.0, and develops a new capability for pitch damping of flared configurations at Mach numbers up to 20. The improved APC also permits determination of aerodynamic effects associated with power-on events and trailing edge flaps.

BRIEF SUMMARY OF THE INVENTION

In various exemplary embodiments, the present invention provides systems and methods to aid engineers and designers in pinpointing optimal aerodynamic designs given a target objective. Advantageously, the present invention allows a user to tackle shifts in requirements or to simply conduct preliminary design feasibilities, quickly and efficiently. The present invention includes: (1) a genetic algorithm-based optimizing routine; (2) an existing semi-empirical, aeropredictive code (APC), and; (3) an interface between the two. The present invention defines bounds for an array of variables that define the overall aerodynamic geometry and performance measures of a device. The genetic algorithm-based optimizing routine interfaces with the APC to determine a design that best fits the requirements.

In an exemplary aspect, a system for optimizing aerodynamic configurations includes one or more processors coupled to memory, wherein the one or more processors are configured to execute: a genetic algorithm-based optimizing routine; an aeropredictive code; and an integration framework to connect the genetic algorithm-based optimizing routine with the aeropredictive code; wherein the genetic algorithm-based optimizing routine is configured to define overall aerodynamic geometry and performance measures of a device responsive to user-defined criteria. The genetic algorithm-based optimizing routine can include the PIKAIA algorithm and the aeropredictive code can include Missile Datcom. The integration framework includes data structure, inputs, supported options for the aeropredictive code, variable parsing, fitness calculation, and outputs. The integration framework can further include data structure, inputs, supported options for the aeropredictive code, variable parsing, fitness calculation, and outputs. Additionally, the integration framework includes control variables operable to control functionality of the genetic algorithm-based optimizing routine and the aeropredictive code; and wherein the control variables include any of population number, number of generations, encoding accuracy, crossover rate, mutation mode, initial mutation rate, minimum mutation rate, maximum mutation rate, fitness differential, reproduction plan, elitism, verbosity, and initial seed. The genetic algorithm based optimizing routine is configured to evolve a plurality of variables associated with the device's geometry. The plurality of variables can include any of nose type, truncated nose, aftbody type, nose length, nose diameter, centerbody length, centerbody diameter, aftbody length, nozzle diameter, fin span, fin chord, fin thickness, truncated fin, and blunt nose. Optionally, the genetic algorithm-based optimizing routine includes a multi-objective optimization scheme based on weighted sums. Alternatively, the genetic algorithm-based optimizing routine includes a roulette wheel selection algorithm for breeding.

In another exemplary aspect, a method for utilizing a genetic algorithm with an aeropredictive code includes receiving a set of constraints and control parameters; initializing a population; utilizing a genetic algorithm to parse chromosomes responsive to the set of constraints and control parameters; and calculating fitness with an aeropredictive code. The genetic algorithm can include the PIKAIA algorithm and the aeropredictive code can include Missile Datcom. The method can further include integrating the genetic algorithm with the aeropredictive code. The set of constraints and control parameters can include control variables operable to control functionality of the genetic algorithm and the aeropredictive code; and wherein the control variables include any of population number, number of generations, encoding accuracy, crossover rate, mutation mode, initial mutation rate, minimum mutation rate, maximum mutation rate, fitness differential, reproduction plan, elitism, verbosity, and initial seed. The genetic algorithm is configured to evolve a plurality of variables associated with a device's geometry. Optionally, the plurality of variables include any of nose type, truncated nose, aftbody type, nose length, nose diameter, centerbody length, centerbody diameter, aftbody length, nozzle diameter, fin span, fin chord, fin thickness, truncated fin, and blunt nose. Alternatively, the genetic algorithm includes a multi-objective optimization scheme based on weighted sums.

In yet another exemplary aspect, a system for integrating a genetic algorithm with an aeropredictive code includes a computer configured to execute: a PIKAIA algorithm; an aeropredictive code; and an integration framework to connect the PIKAIA algorithm with the aeropredictive code; wherein the PIKAIA algorithm is configured to define overall aerodynamic geometry and performance measures of a device responsive to user-defined criteria. The PIKAIA algorithm is configured to evolve a plurality of variables associated with the device's geometry; and wherein the plurality of variables include any of nose type, truncated nose, aftbody type, nose length, nose diameter, centerbody length, centerbody diameter, aftbody length, nozzle diameter, fin span, fin chord, fin thickness, truncated fin, and blunt nose. The genetic algorithm-based optimizing routine can include a multi-objective optimization scheme based on weighted sums. Optionally, the genetic algorithm-based optimizing routine includes a roulette wheel selection algorithm for breeding.

BRIEF DESCRIPTION OF THE DRAWINGS

The present invention is illustrated and described herein with reference to the various drawings, in which like reference numbers denote like method steps and/or system components, respectively, and in which:

FIG. 11 illustrates fitness values of the best and average configurations of each generation and external shapes according to an exemplary embodiment of the present invention;

DETAILED DESCRIPTION OF THE INVENTION

In various exemplary embodiments, the present invention provides systems and methods to aid engineers and designers in pinpointing optimal aerodynamic designs given a target objective. Advantageously, the present invention allows a user to tackle shifts in requirements or to simply conduct preliminary design feasibilities, quickly and efficiently. The present invention includes: (1) a genetic algorithm-based optimizing routine; (2) an existing semi-empirical, aeropredictive code (APC), and; (3) an interface between the two. The present invention defines bounds for an array of variables that define the overall aerodynamic geometry and performance measures of a device. The genetic algorithm-based optimizing routine interfaces with the APC to determine a design that best fits the requirements.

Figure 1:
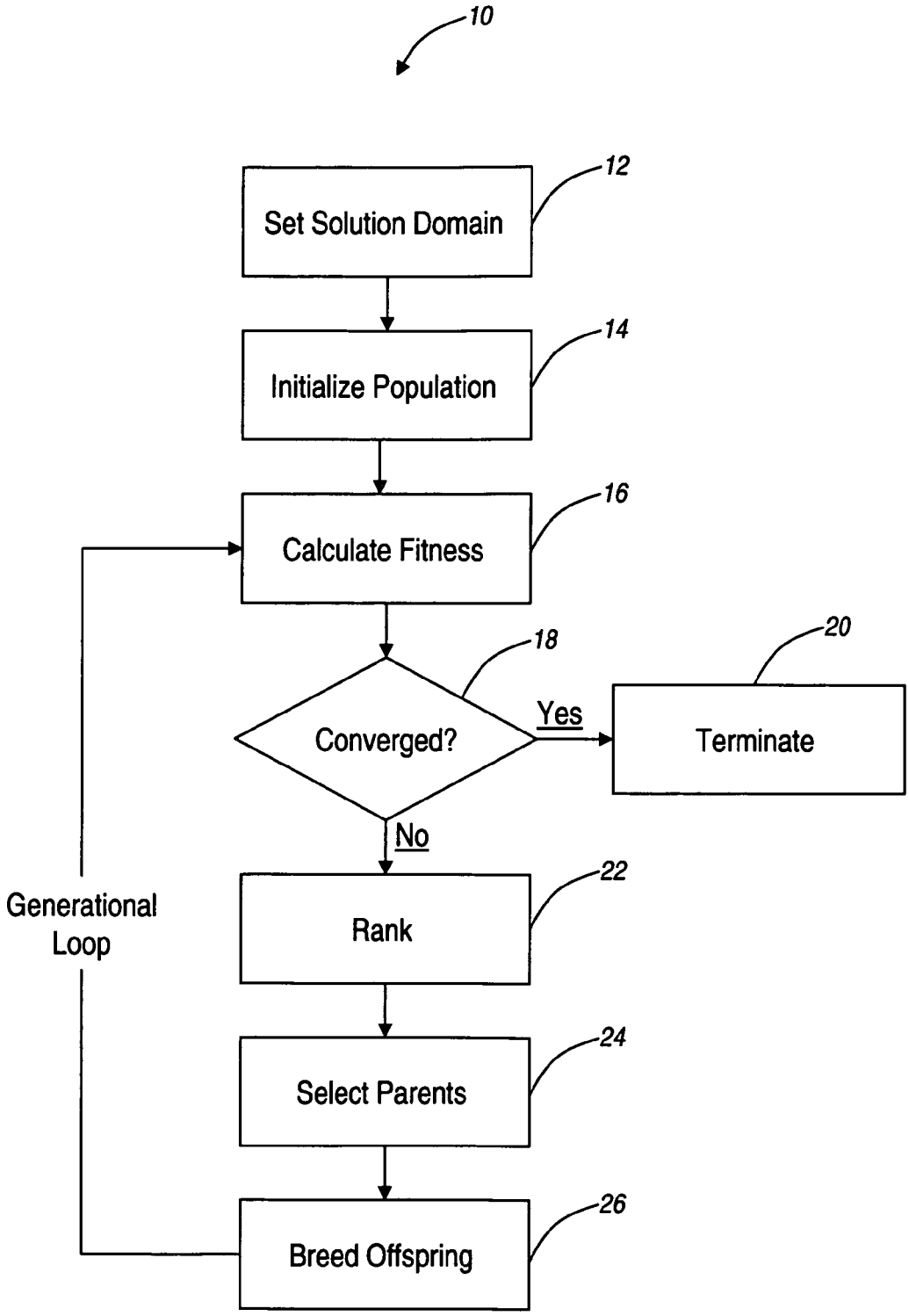
FIG. 1 illustrates a flowchart of a genetic algorithm according to an exemplary embodiment of the present invention.

Referring to FIG. 1, a genetic algorithm 10 is illustrated according to an exemplary embodiment of the present invention. The genetic algorithm 10 incorporates operators and procedures reminiscent of the theory of survival of the fittest. This allows the combination of candidate solutions to 'breed' new ones which results in an effective procedure of investigating the entire solution domain of interest. Advantageously, the genetic algorithm 10 provides complex optimization for problems requiring multiple, sometimes diverse, goals or objectives.

The genetic algorithm 10 uses heuristic search techniques to find either exact or best fit solutions to an optimization problem. The nature of the problem, i.e. whether it is a single- or multi-objective optimization, dictates what type of solution will be obtained upon completion. Simply put, the genetic algorithm 10 randomly generates a population of candidate solutions and evolves them from generation to generation until either a convergence criterion is met or the maximum number of generations has been generated. The size of the population, number of generations, variables defining the solution domain, and convergence criteria are all inputs the user supplies.

First, a user provides the genetic algorithm 10 with the required input parameters, which include the population size, number of generations to evolve, variables defining the solution individuals, lower and upper bounds for these variables, convergence criteria (if applicable), and the like. These inputs define the so-called solution domain (step 12).

Next, to initialize the simulations, the genetic algorithm 10 generates an initial population by randomly generating values for each of the variables (step 14), referred to as either chromosomes or genotypes, defining a candidate solution (phenotype). This process is iteratively performed until the desired population size is defined. By populating the design space in a random fashion, the genetic algorithm 10 eliminates any bias towards a particular configuration. The randomness ensures that a diverse population has been captured and the genetic algorithm 10 can then learn the effects of each variable, as well as the coupling between them, on the overall configuration across the solution domain. It is important to note that the genetic algorithm 10 traditionally encodes the chromosomes using binary strings. However, encodings relying on integer arrays or other mechanisms can also be used.

The next step is the evaluation of each phenotype's fitness value, which is a measure of the phenotype's quality and defines how well it meets the genetic algorithm's 10 objective(s) (step 16). Fitness values are calculated by a user-defined function that is specific to each problem. In every genetic algorithm, the calculation of fitness values is usually the most time-consuming and computationally-intensive segment. Here, parallel computing schemes can be utilized in which the calculation of population fitness is spread among various processors to reduce turn-around times, particularly in problems with large population sizes or complicated fitness functions.

The fitness values are checked to determine if they have converged (step 18), and if so, the genetic algorithm 10 terminates (step 20). If not, then the genetic algorithm 10 proceeds to use the fitness values for generating a new population by breeding individuals from the current population. The current population is ranked based on each phenotype's fitness (step 22): It has been found that using the exact fitness value as a measure of breeding probability suffers from several downfalls and so researchers have postulated several mechanisms to tackle these issues which can be used.

With the population ranked, multiple individuals are then stochastically selected from the population to serve as parents (step 24). Even though the objective is to breed a new, more fit generation, some genetic algorithms 10 can be designed to purposefully select a small portion of less fit individuals for breeding to aid in maintaining population diversity throughout the evolutionary process. This approach in turn helps prevent premature convergence on a solution that may not be optimal for the objective(s) identified.

Figure 2:
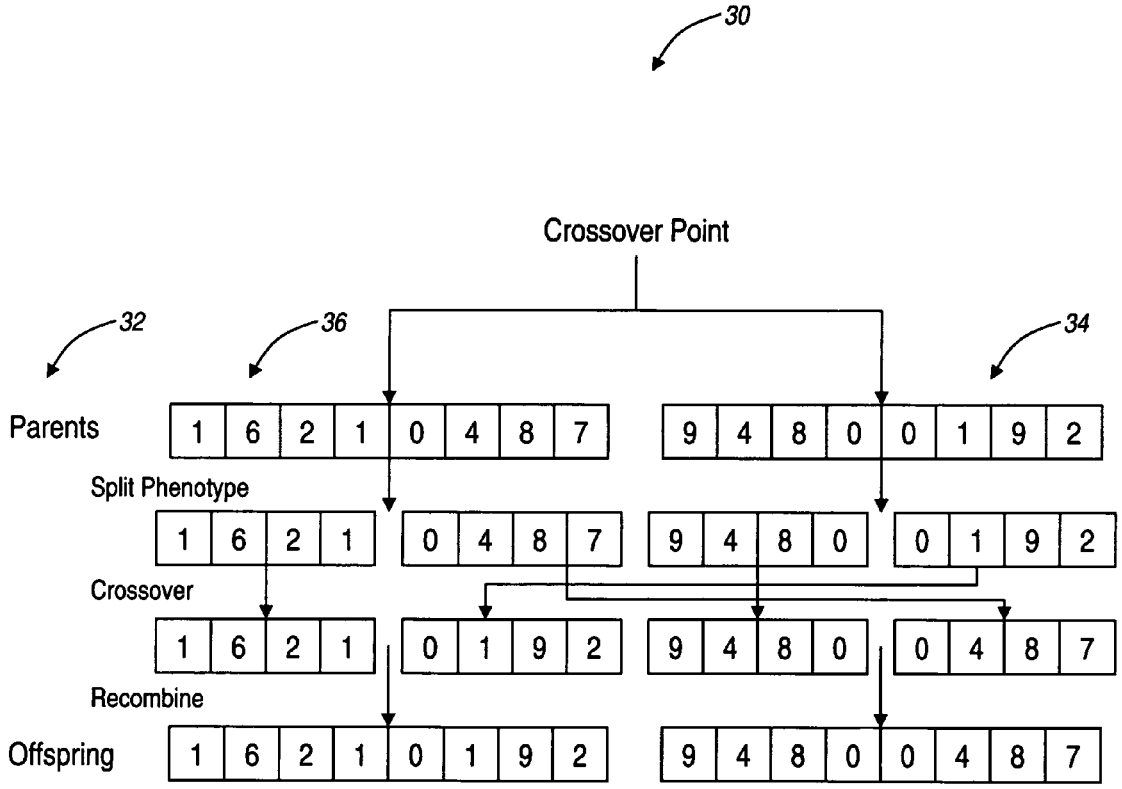
FIG. 2 illustrates a crossover genetic operation according to an exemplary embodiment of the present invention.

The selected parents are bred by applying some type of genetic operator (step 28), the most common of which is crossover (or recombination). Referring to FIG. 2, a crossover genetic operation 30 is illustrated according to an exemplary embodiment of the present invention. Here, the genetic composition of each parent 32 is made up of an array of eight digits (i.e., eight variables). The crossover genetic operation 30 proceeds by randomly selecting a point at which to break each parent's 32 composition, this point being the midpoint in the case illustrated in FIG. 2. For example, the second chromosome fragment from a second parent 34 is interchanged and merged with a first fragment from a first parent 36 to create a new offspring. The same procedure is repeated for the first fragment from the parent 34 and the first from the parent 36 to create a second offspring. This type of crossover is known as single-point crossover since only one partition point is used. Multi-point crossovers can also be used.

An important aspect of the genetic algorithm breeding process, which is traced back to their roots in evolutionary biology, is the incorporation of mutation operators. In the crossover example of FIG. 2, each offspring has a certain probability of having its composition altered randomly. If this probability is met, a randomly chosen variable's (genotype) value is replaced by another value, which is also determined in a random fashion. The value of a mutation operator is that they also allow diversity to be maintained within the population. In some cases, the genetic algorithm 10 may have reached a point in the simulation where all the phenotypes are converging on a solution that may not be the optimal. Random mutations can help in steering the genetic algorithm 10 towards an area of the solution domain that has not been thoroughly explored and possibly identifying the best solution.

Referring back to FIG. 1, after step 26, the genetic algorithm 10 returns to step 16 to repeat the process. The fitness values of the new population are calculated and, if applicable, are compared to user-supplied convergence criteria (step 18). Generally, fitness values increase as generations evolve since the genetic composition of the fittest individuals is used in the breeding process. If the convergence criteria are met, or if the maximum number of generations has been evolved, the program terminates (step 20), otherwise, the iterative process continues.

In an exemplary embodiment, the present invention can utilize the PIKAIA algorithm for the genetic algorithm 10. The PIKAIA algorithm, available from the High Altitude Observatory (HAO) of the National Center for Atmospheric Research at www.hao.ucar.edu/Public/models/pikaia/pikaia.html, was originally developed as a learning tool and has evolved to the point of being used in the field of astronomy.

The PIKAIA algorithm incorporates only two basic genetic operators: a uniform one-point crossover and a uniform one-point mutation. The encoding within PIKAIA is based on a decimal alphabet made of the 10 simple integers (0 through 9); this is because binary operations are usually carried out through platform-dependent functions in FORTRAN. Three reproduction plans are available: Full generational replacement, Steady-State-Delete-Random, and Steady-State-Delete-Worst. Elitism is available and is a default option: The mutation rate can be dynamically controlled by monitoring the difference in fitness between the current best and median in the population (also a default option). Selection is rank-based and stochastic, making use of a Roulette Wheel Algorithm.

Figure 3:
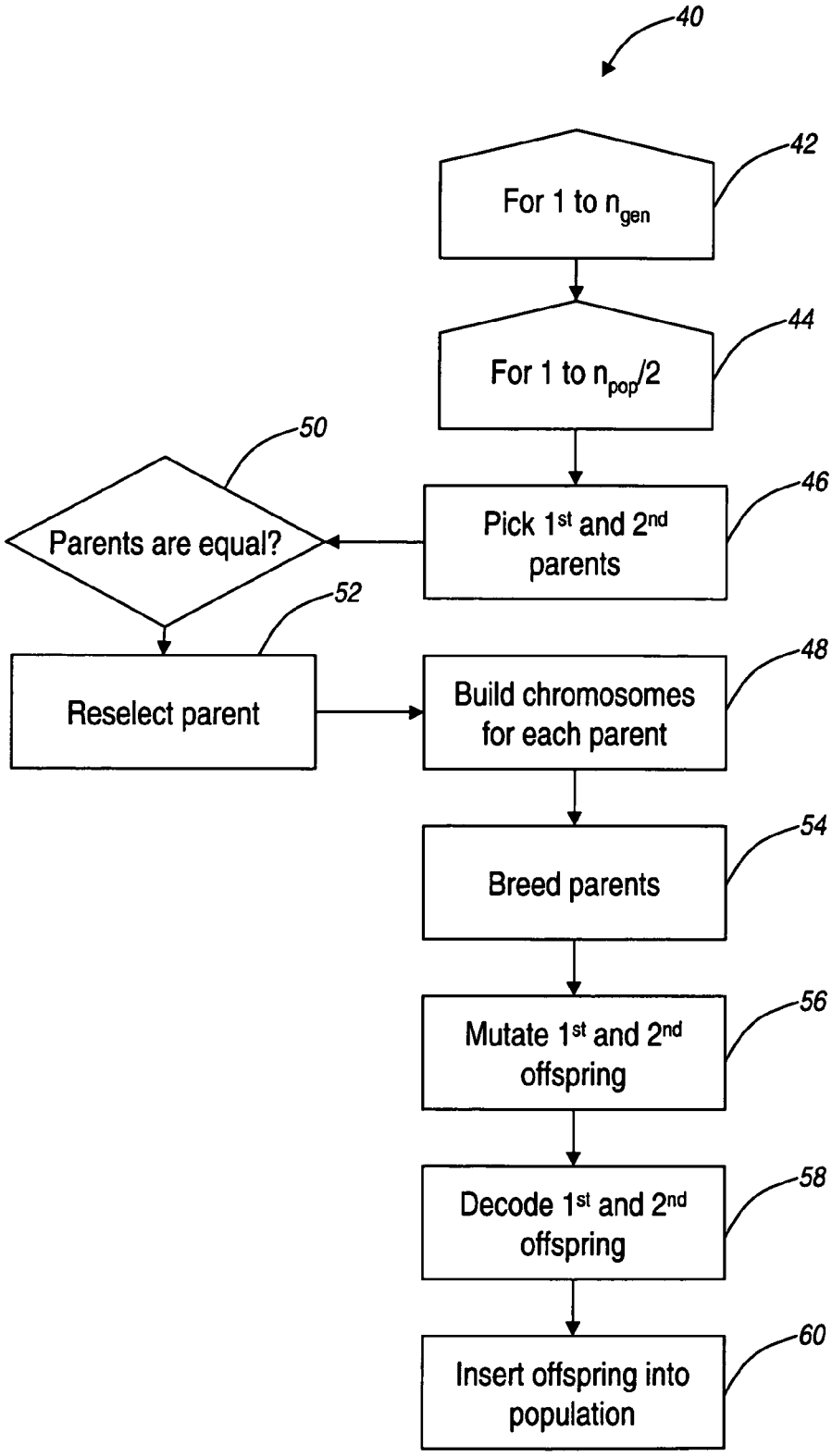
FIG. 3 illustrates a flowchart of a PIKAIA algorithm according to an exemplary embodiment of the present invention.

Referring to FIG. 3, a PIKAIA algorithm 40 is illustrated according to an exemplary embodiment of the present invention. The PIKAIA algorithm 40 is designed to maximize a function $f(x)$, which the user must supply, within an n-dimensional domain. That is, $$x \equiv (x_1, x_2, \ldots, x_n), x_k \in [0.0, 1.0] \forall k. \quad (1)$$

Variables can be restricted to the [0.0, 1.0] range to allow for greater flexibility and portability. Thus, a key component of any framework making use of the PIKAIA algorithm 40 is this inclusion of a routine that normalizes the input variables.

A maximization procedure can be carried out on a population of $n_{pop}$ individuals (candidate solutions). This population size, $n_{pop}$, remains constant throughout the evolutionary process and is provided as input. The evolution can conducted through a user-specified number of generations, $n_{gen}$, instead of comparing its fitness against some predetermined convergence criterion to provide as simple and general a subroutine as possible.

The PIKAIA algorithm 40 includes two nested loops 42, 44. For reference, the nested loop 42 is referred to as the generational cycle and the nested loop 44 is referred to as the reproductive cycle. Two offspring are generated upon completing a single iteration of the reproductive cycle from the two selected parents, thereby necessitating only $n_{pop}/2$ executions in order to populate the new generation of size $n_{pop}$. This latter parameter must be an even number; otherwise the PIKAIA algorithm 40 truncates it, issues a warning message, and proceeds with the simulation.

Each iteration within the reproductive cycle entails selecting two parents for breeding (step 46) and constructing their chromosomes/genotypes ($gn_1/gn_2$) from their respective phenotypes ($ph_i/ph_2$) (step 48). Also, the PIKAIA algorithm 40 checks (step 50) to ensure that the selected parents are not the same, and if so, selects a new second parent (step 52) to prevent breeding with the same parent. The two are bred by applying a crossover operator (step 54), such as described in FIG. 2, and the resulting offspring chromosomes are mutated if a certain mutation probability is met (step 56). The final step required to generate new candidate solutions/offspring is the decoding of their chromosomes into their corresponding phenotypes (step 58).

The PIKAIA algorithm 40 provides a user with several options regarding the manner in which each new offspring is inserted to the population (step 60). The offspring can either be accumulated in a temporary storage or progressively inserted to the population as they are bred. If the reproductive cycle calls for the offspring to be inserted in temporary storage, they are transferred to the main population upon completing a full iteration of the generational cycle, therefore replacing an old population in a two-dimensional array dyn_vars of size [$n_{var}$, $n_{pop}$], where $n_{var}$ is the number of variables defining the design space.

The present invention avoids solution biases by developing an initial population in a random fashion. In the PIKAIA algorithm 40, each of the n parameters that define each of the $n_{pop}$ individuals is initialized with a random number R∈[0.0, 1.0]. For example, the PIKAIA algorithm 40 can utilize a subroutine to return a uniformly distributed random real number within the [0.0 1.0] range.

Fitness values for each individual are calculated and stored within a fitness array. Upon PIKAIA algorithm 40 initiation, the population will generally have a very low fitness value overall simply due the manner in which it was initialized. However, there will always be individuals which perform better than most, fulfilling the only requirement for the enforcement of natural selection within a population. It is up to the evolutionary process to produce better-than average offspring with this survival-of-the-fittest paradigm. Finally, the population is ranked in both ascending and descending order (in arrays $i_{fit}$ and $j_{fit}$, respectively). They are used internally by the PIKAIA algorithm 40 to track where individuals are stored in a population matrix.

The sampling technique used to select both parents in each iteration of the reproductive cycle within the PIKAIA algorithm 40 is stochastic (random) in nature. This technique is setup so that the probability of an individual being chosen for breeding is directly proportional to that individual's fitness.

Figure 4:
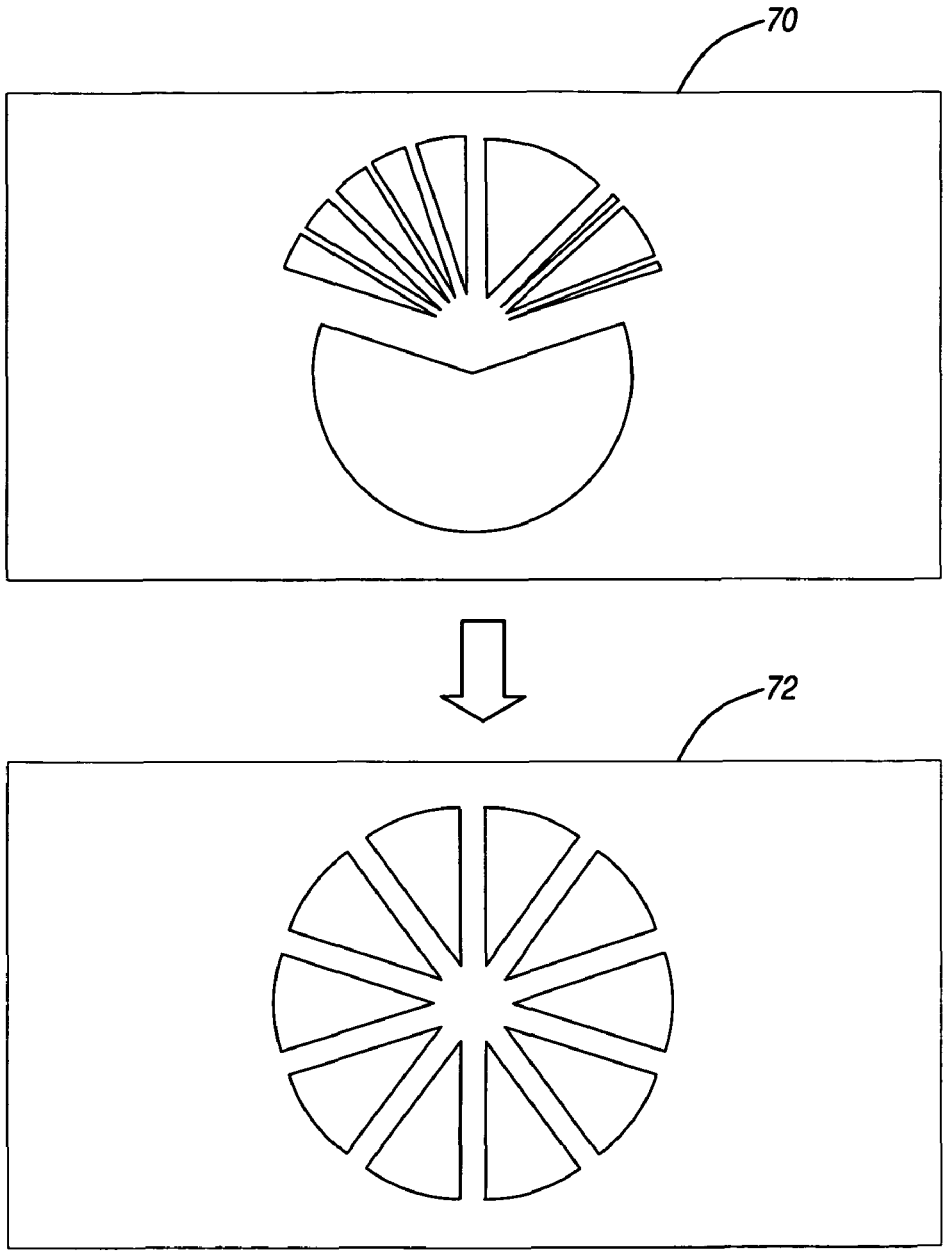
FIG. 4 illustrates a roulette wheel selection algorithm for the PIKAIA algorithm of FIG. 3 according to an exemplary embodiment of the present invention.

Referring to FIG. 4, the PIKAIA algorithm 40 can utilize a roulette wheel selection algorithm according to an exemplary embodiment of the present invention. In a roulette wheel selection algorithm, each individual's fitness value can be thought of as the 'real estate' it owns within a circular wheel 70 akin to a roulette wheel. Let $S_i$ define the fitness of individual i and compute both the sum of all fitness values in the population and a running sum:

$$F = \sum_{i=1}^{npop} S_i \tag{2}$$

$$T_j = \sum_{i=1}^{j} S_i, \quad \text{for } j = 1, \ldots, n_{pop} \tag{3}$$

From Eq. 3 it is understood that $T_{j+1} \geqq T_j$ and $T_{npop}=F$. Next, a random number is generated such that R∈[0.0, F] and an element $T_j$ is identified such that $$T_{j+1} \leqq R \leqq T_j \tag{4}$$

Only one individual, j, can satisfy the conditions in Eq. 4, which results in it being selected for breeding. The generation of the random number, R, corresponds to the spinning of the wheel 70.

From this analogy, it is evident that the higher the fitness value an individual has, the greater the probability of it being chosen as a parent. While this procedure is a very simple and straightforward procedure, researchers have made direct use of fitness values to determine those individuals selected for breeding, which creates large biases and may lead to a large portion of the design domain being ignored. Nonetheless, a true optimum solution may lie within this region.

To circumvent this issue, the PIKAIA algorithm 40 incorporates a natural-selection-type scheme where the individuals in a generation are ranked from 1 to $n_{pop}$, with 1 being the most fit (array $i_{fit}$). Utilizing $i_{fit}$ as the probability of breeding ensures that a suitable fitness differential, otherwise known as selection pressure, is maintained throughout the entire population. In the selection algorithm being discussed, this ranking scheme assures that each individual has an equivalent angular real estate on a wheel 72, as illustrated in FIG. 4. The explicit fitness values of the ten configurations shown in the FIG. 4 on a wheel 72 are ranked by the above-mentioned method and the result is the wheel 72 with equivalently spaced slices. This ranking scheme ensures that the entire parameter space is explored by the PIKAIA algorithm 40.

The objective of the encoding procedure is to translate the genetic information of each selected parent into a form suitable for breeding. That is, the PIKAIA algorithm 40 generates a chromosome for each individual based on the information stored within the $n_{var}$ parameters defining the function $f(x)$ to be maximized. These parameters can be encoded using one-digit base ten integers instead of a binary encoding commonly used in other genetic algorithms. In other words, $$x_k \in [0.0, 1.0] \rightarrow X_k = (X_1, X_2, \ldots, X_{nd})_k, \tag{5}$$

where the $X_j \in [0, 9]$ are positive integers.

Here, a parameter ndg corresponds to the desired number of significant digits. By applying the following encoding algorithm, $$X_j = \mathrm{mod}(10^{ndg-j+1} x_k, 10), j = 1, 2, \ldots, nd \tag{6}$$

each of the $n_{var}$ parameters becomes a sequence of nd 1-digit integers, thus producing a 1-dimensional integer array of length $n_{var} \times ndg$. Subsequently, the corresponding decoding algorithm is:

$$x_k = \frac{1}{10^{ndg}} \sum_{j=1}^{ndg} X_j \times 10^j \tag{7}$$

As an example of the above procedure, consider the maximization of a two-variable function, $f(x\,y)$. Each individual in such a design space will consist of a point (x, y). Therefore, if ndg=4, an encoding procedure produces (x, y)=(0.1621, 0.0487)→16210487, which corresponds to parent 36 in FIG. 2. This chromosome (16210487) is made up of eight genes and is the full genotype of the phenotype (x, y).

The PIKAIA algorithm 40 incorporates a one-point crossover operator. It is applied on a pair of parent-chromosomes to produce two offspring chromosomes. Going back to the example in FIG. 2, the two parents are:

$(x, y)_1$=(0.1621, 0.0487)

$(x, y)_2$=(0.9480, 0.0192);

Encoding these to four significant digits produces 16210487 and 94800192.

Once these are stored in the appropriate array, the crossover operator selects a point along which the genetic information is split. That is, the PIKAIA algorithm 40 generates a random integer K∈[1, $n_{var}$×ndg] and cuts both parent chromosomes along the corresponding locus. In FIG. 2, K was evaluated as 4. The chromosome fragments are interchanged between parents, concatenated, and decoded to produce two new offspring.

In actuality, the crossover operation is not performed unless a probabilistic test yields a positive result. The user defines a crossover rate pcross in the range [0.0, 1.0] and the PIKAIA algorithm 40 generates a random number R∈[0.0, 1.0]. If R>pcross, the crossover operation proceeds, otherwise, the two offspring remain an exact copy of their parents.

A uniform single-point mutation operator can be incorporated in the PIKAIA algorithm 40. The user has the option to select either a static, uniform or dynamic mutation rate. Both the uniform and dynamic mutation operators work exactly the same way. For each gene of an offspring chromosome, a random number R∈[0.0, 1.0] is generated and mutation is conducted on the gene only if R≦pmut, where pmut∈[0.0, 1.0] is the user-input mutation rate. The mutation itself consists of replacing the selected gene by a random integer K∈[0, 9].

It is useful to note that even though the mutation operation is conducted uniformly across the genotype, the effects on the phenotype can be substantial. Even though changes are effected on individual genes, the parameter bounds imposed by the encoding/decoding process are preserved. Hence, the combination of the crossover and mutation operators gives genetic algorithms great flexibility and multiple paths of exploring the entire search space.

From intuition, it is understood that the application of a mutation operator can affect the evolutionary process favorable or provide little benefit. For example, upon crossing two parents, the resulting offspring could have the genetic makeup of a potentially superior individual. By altering a single gene of this offspring could result in development of a less-than-average individual and so the evolutionary process will be forced to delete it and continue searching. While this might seem as an unfavorable quality of mutation, the fact remains that it is usually the premier mechanism safeguarding against premature convergence on a secondary extremum and also ensures that population diversity is maintained.

It is also understood that the choice of an optimal value of mutation rate, pmut, will depend greatly on the individual problem and cannot be made a priori. Therefore, the PIKAIA algorithm 40 is set up to monitor the degree of convergence in the population and can adjust pmut accordingly. Using the actual fitness values of the best and median individuals in the population, the quantity ΔS is defined as:

$$\Delta S = \frac{S(r=1) - S(r=np/2)}{S(r=1) + S(r=np/2)}, \tag{8}$$

and measures the degree of convergence of the population. The mutation rate is adjusted (increased/lowered) whenever this quantity is smaller/larger than a predetermined level.

While the crossover operation presented above could be considered the actual 'reproduction,' in genetic algorithms reproduction plans refer to the manner in which the offspring are incorporated into the population. The user is given the option to choose between three reproduction plans: Full generational replacement (FGR); Steady-state reproduction (SS); and Select-Random-Delete-Worst (SRDW).

The full generational replacement reproduction (FGR) plan is the simplest mechanism of evolving a population. As the reproductive cycle iterates to generate the next generation, offspring are accumulated in temporary storage. Once $n_{pop}$ offspring have been bred, the parent population is replaced by the new generation. At this point, the evolutionary process is repeated; fitness values are calculated, population is ranked, parents selected and crossed, and offspring are bred and inserted accordingly. Under a FGR, individuals have a limited lifespan equal to a single generation.

In steady-state (SS) reproduction plans, offspring are continuously incorporated into the population as they are bred. However, certain criteria need to be specified in order to determine: 1. under what conditions newly-bred individuals are inserted; 2. how individuals in the parent population are deleted to allow for offspring incorporation; and 3. if any limit is to be imposed on an individual's lifespan.

Two SS plans are available to the user within the PIKAIA algorithm 40, steady-state-delete-worst (SSDW) and steady-state-delete-random (SSDR), and differ only in the manner in which parents are deleted to accommodate the offspring. In either plan, the offspring are judged suitable for insertion whenever their fitness value exceeds that of the least fit in individual in the parent population. An exception is made whenever an offspring is identical to an existing member of the population. Regarding the lifespan of the individuals, no limit imposed on the generational lifetime of a population member. Therefore, a particularly fit individual can survive through a significant number of generational cycles.

Under SS plans, a generational cycle is defined as the production of $n_{pop}$ individuals. Internally, no distinction is made on how many offspring are actually inserted into the population. With the SSDW plan, the PIKAIA algorithm 40 selects the least fit individual in the parent population and replaces it with the newly-bred offspring. In contrast, the SSDR plan randomly identifies a member of the parent population for deletion, regardless of its relative fitness.

The select-random-delete-worst (SRDW) plan is a derivative of the SS reproductive plans. Here, parents are selected completely at random and natural selection is enforced to make room for the offspring: the probability of being selected for deletion is made inversely proportional to an individual's fitness.

As discussed above, only the steady-state-delete-worst reproduction plan can guarantee that the fittest individual survives from generation to generation. Furthermore, it has also been shown that the combination of crossover and mutation operators can have disruptive effects on the evolutionary process. To alleviate this phenomenon, the strategy of elitism is commonly used in genetic algorithms as a means of evolving towards convergence as efficiently as possible. Elitism is implemented slightly different depending on the reproduction plan. If a FGR plan is being used, elitism consists of simply saving the most fit individual of the parent population in temporary storage and reinserting it at the end of the generational iteration.

Aerodynamic problems require a careful balance between many factors, all of which have a unique, non-linear effect on the overall configuration's performance. A design that reduces overall drag may not be the most efficient as it may not have proper stability and not be very accurate. On the other hand, a highly stable platform could generate unacceptable levels of drag, giving rise to the possibility of not fulfilling a crucial requirement such as range.

The PIKAIA algorithm's 40 single-function optimization structure can be maintained by incorporating a multi-objective optimization scheme based on weighted sums. In this scheme, the user assigns a weight, $w_i$, to each normalized objective function, $f'(x)$, reducing the optimization of multiple objectives to that of a single function as:

$$F=w_1f'1(x)+w_2f'2(x)+\ldots+w_kf'k(x). \quad (9)$$

In Eq. 9, $f_i(x)$ corresponds to the normalized objective function $f_i(x)$ and $\Sigma w_i=1$. The advantage of this approach is its simplicity. However, the user is required to supply the weight factors, a task which is not straightforward and requires some trial and error. For example, the user can be given the option to perform an optimization considering a maximum of two objectives, these being aerodynamic stability and aerodynamic efficiency. The parameters chosen to define a configuration's aerodynamic efficiency and stability are the ratio of normal-to-axial forces and static margin, respectively.

As described herein, the present invention utilizes genetic algorithms with APC codes. Various APCs exist, such as the U.S. Air Force's Missile Datcom (MD) and the APC described in Moore et al., U.S. Pat. No. 6,721,682 issued Apr. 13, 2004. The MD is an aerodynamics engineering code widely used in industry to estimate conventional missile configuration designs in a quick and efficient manner. These latter qualities make MD ideally suited for integration into a genetic algorithm, where an extensive amount of configurations need to be analyzed. It is assumed that a conventional design is one including: (1) an axisymmetric or elliptically-shaped body; (2) one to four (insets, each with one to eight identical panels attached around the projectile's circumference; and (3) an air-breathing propulsion system.

The MD can be modified for use with the genetic algorithms described herein. These modifications include: 1. calculation of the required fitness-measuring parameters; 2. output of a new data file containing the above fitness values as well as suppressing all unnecessary writes; and 3. extending array sizes to accept input decks with 250-plus cases/configurations.

The normal-to-axial-force ratio ($C_N/C_A$) and static margin ($X_{cp}$, measured in calibers) are the two parameters used to measure a configuration's aerodynamic efficiency and stability, respectively. MD runs the user-defined flight conditions, which generally sample a range of Mach numbers and angles of attack, and calculates $C_N/C_A$ and $X_{cp}$, among other parameters, at each point. The overall performance of each individual is then measured as the sum of the performance at each unique flight condition, i. For example, $$(C_N/C_A)_{tot}=\sum_{i}^{nc}(C_N/C_A)_i \quad (10)$$

where nc is the total number of flight conditions. The same summation is conducted when static margin is the performance parameter.

Two important things need to be pointed out about the $X_{cp}$ variable. First, MD calculates static margin as the ratio of pitching moment to normal force, the former being calculated about a user-specified point. Depending on the aerodynamic configuration, it is possible to run into numerical problems at an angle of attack of zero, where the normal force can potentially be zero. MD now scans the static margin data for discontinuities as it is calculated to ensure a continuous curve for the $X_{cp}$ throughout the entire flight regime.

Second, recall that the genetic algorithm, the PIKAIA algorithm 40, is tasked with maximizing a particular objective. While little or no drawbacks can be found in a configuration with infinite aerodynamic efficiency, difficulties arise in a platform that is too stable. In such cases, exposure to even the slightest wind gust or crosswind could potentially set the projectile off-course as it seeks to align itself in the direction of the disturbance. Of course, the other end of the spectrum, where a platform has a very low stability margin, also poses aerodynamic issues since it corresponds to a highly unstable configuration.

To avoid the issues just described, the user is given the option to provide a target static margin ($X_{cp\text{-}tar}$, in calibers). The measure of performance will be based on how closely the individual configuration's static margin compares with this value. This determination is accomplished by calculating the inverse of the difference between the actual and target static margins (also shown below in Eq. 11). The inverse is used to meet the maximization convention. Note that the code can have a value of 1.5 hardwired for the target static margin. The capability to specify this parameter by way of an input card or namelist can be built into the code.

$$(X_{cp})_{tot}=\sum_{nc}\frac{1}{\{(X_{cp})_i+X_{cp-tar}+\varepsilon\}} \quad (11)$$

As before, nc is the total number of flight conditions. $\epsilon$ is a constant set to $10^{-6}$ to guard against the possibility of dividing by zero.

In an exemplary embodiment, MD is a computer-executable program that is run separate from the genetic algorithm. Accordingly, the fitness data calculated in the genetic algorithm needs to be organized in a form that is useable within MD. For this reason, MD can be modified to output both objective functions, where the data is organized in tabular format and preserve the order in which the configurations are stored in the GA array dyn_vars. An example is provided in a table below. The first column corresponds to the configuration case (also the index of array dyn_vars), followed by the sums of the aerodynamic and stability performance objectives.

| 'CASE' | 'CNCASUM' | 'XCPSUM' |
|---|---|---|
| 1 | 2286.5632 | 9797.5771 |
| 2 | 11022.8887 | 19.8240 |
| 3 | 1802.5106 | 299.5892 |
| 4 | 8509.4297 | 145.5752 |
| 5 | 1819.2942 | 245.8551 |
| 6 | 2342.5659 | 638.3815 |
| 7 | 7135.2534 | 533.0596 |
| 8 | 4348.2686 | 40.1087 |
| 9 | 935.7397 | 129.8219 |
| 10 | 4277.0586 | 38.9208 |

Figure 5:
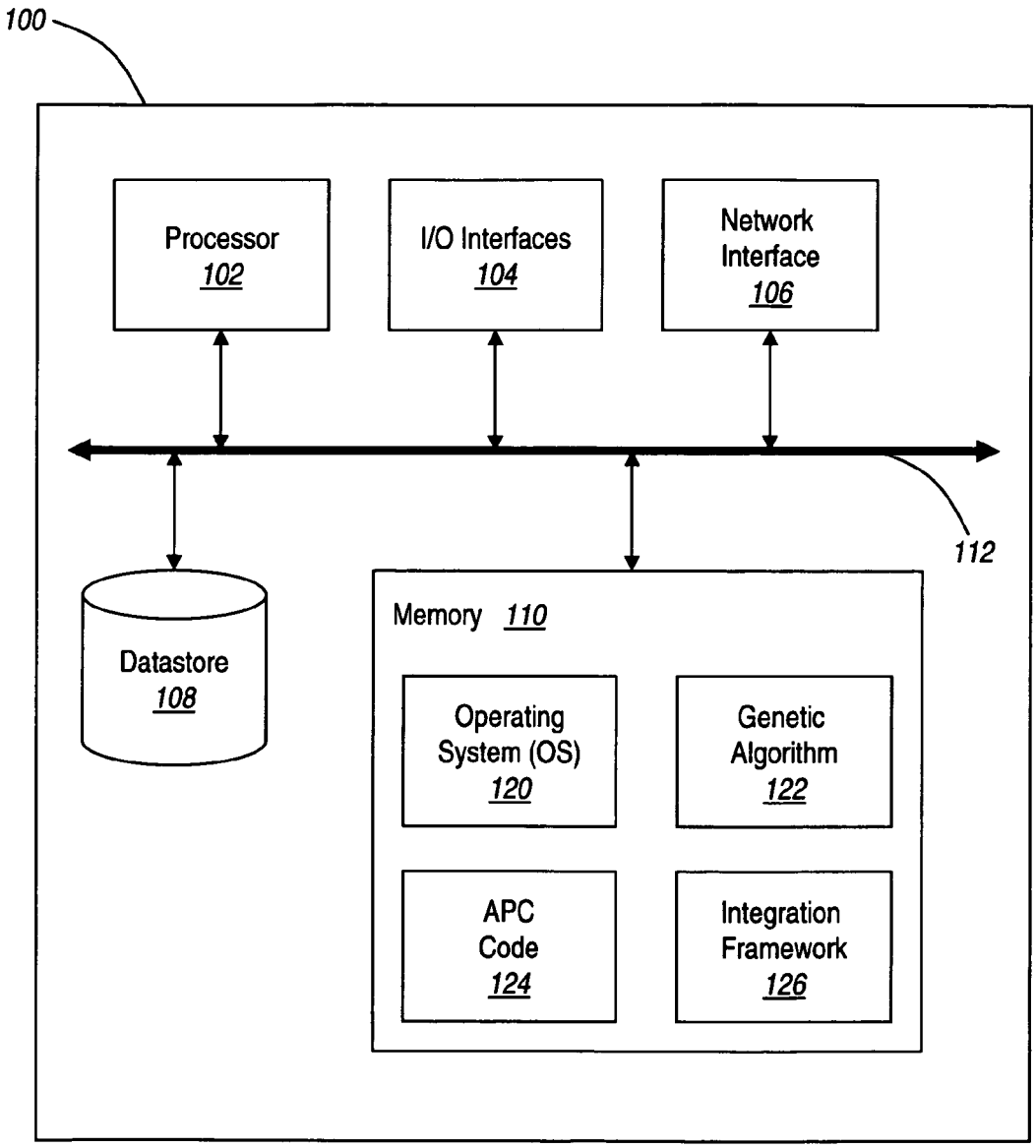
FIG. 5 illustrates a block diagram of a computer configured to, responsive to computer-executable code, integrate a genetic algorithm-based optimizing routine with an existing semi-empirical, aeropredictive code (APC) according to an exemplary embodiment of the present invention.

Referring to FIG. 5, a block diagram illustrates a server 100 configured to be responsive to computer-executable code, integrate a genetic algorithm-based optimizing routine with an existing semi-empirical, aeropredictive code (APC) according to an exemplary embodiment of the present invention. The server 100 can be a digital computer that, in terms of hardware architecture, generally includes a processor 102, input/output (I/O) interfaces 104, network interfaces 106, a data store 108, and memory 110. The components (102, 104, 106, 108, and 110) are communicatively coupled via a local interface 112. The local interface 112 can be, for example but not limited to, one or more buses or other wired or wireless connections, as is known in the art. The local interface 112 can have additional elements, which are omitted for simplicity, such as controllers, buffers (caches), drivers, repeaters, and receivers, among many others, to enable communications. Further, the local interface 112 can include address, control, and/or data connections to enable appropriate communications among the aforementioned components.

The processor 102 is a hardware device for executing software instructions. The processor 102 can be any custom made or commercially available processor, a central processing unit (CPU), an auxiliary processor among several processors associated with the server 100, a semiconductor-based microprocessor (in the form of a microchip or chip set), or generally any device for executing software instructions. When the server 100 is in operation, the processor 102 is configured to execute software stored within the memory 110, to communicate data to and from the memory 110, and to generally control operations of the server 100 pursuant to the software instructions.

The I/O interfaces 104 can be used to receive user input from and/or for providing system output to one or more devices or components. User input can be provided via, for example, a keyboard and/or a mouse. System output can be provided via a display device and a printer (not shown). I/O interfaces 104 can include, for example, a serial port, a parallel port, a small computer system interface (SCSI), an infrared (IR) interface, a radio frequency (RF) interface, and/or a universal serial bus (USB) interface.

The network interfaces 106 can be used to enable the server 100 to communicate on a network. The network interfaces 106 can include, for example, an Ethernet card (e.g., 10BaseT, Fast Ethernet, Gigabit Ethernet) or a wireless local area network (WLAN) card (e.g., 802.11a/b/g/n). The network interfaces 106 can include address, control, and/or data connections to enable appropriate communications on the network. A user can log on and communicate with the server 100 remotely through the network interfaces 106.

A data store 108 can be used to store data, such as fitness data, MD data, etc. The data store 108 can include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 108 can incorporate electronic, magnetic, optical, and/or other types of storage media. In one example, the data store 108 can be located internal to the server 100 such as, for example, an internal hard drive connected to the local interface 112 in the server 100.

The memory 110 can include any of volatile memory elements (e.g., random access memory (RAM, such as DRAM, SRAM, SDRAM, etc.)), nonvolatile memory elements (e.g., ROM, hard drive, tape, CDROM, etc.), and combinations thereof. Moreover, the memory 110 may incorporate electronic, magnetic, optical, and/or other types of storage media. Note that the memory 110 can have a distributed architecture, where various components are situated remotely from one another, but can be accessed by the processor 102.

The software in memory 110 can include one or more software programs, each of which includes an ordered listing of executable instructions for implementing logical functions. In the example of FIG. 5, the software in the memory 110 includes a suitable operating system (O/S) 120, a genetic algorithm 122, an APC code 124, and an integration framework 126. The operating system 120 essentially controls the execution of other computer programs, such as the genetic algorithm 122, the APC code 124, and the integration framework 126, and provides scheduling, input-output control, file and data management, memory management, and communication control and related services. The operating system 120 may be any of Windows NT, Windows 2000, Windows XP, Windows Vista (all available from Microsoft, Corp. of Redmond, Wash.), Solaris (available from Sun Microsystems, Inc. of Palo Alto, Calif.), LINUX (or another UNIX variant) (available from Red Hat of Raleigh, N.C.), or the like.

In an exemplary embodiment, the genetic algorithm 122 can include the PIKAIA algorithm 40 or the like and the APC code 124 can include the MD or the like. The present invention is illustrated with respect to the PIKAIA algorithm 40 and the MD, but those of ordinary skill in the art will recognize that the present invention can be utilized with any genetic algorithm-based optimizing routine integrated with any semi-empirical, aeropredictive code (APC).

The integration framework 126 illustrates a mechanism to tie the genetic algorithm 122 and the APC code 124 together, e.g. the PIKAIA algorithm 40 with the MD. As described herein, the present invention includes: (1) a genetic algorithm-based optimizing routine; (2) an existing semi-empirical, aeropredictive code (APC), and; (3) an interface between the two. The present invention defines bounds for an array of variables that define the overall aerodynamic geometry and performance measures of a device. The genetic algorithm-based optimizing routine interfaces with the APC to determine a design that best fits the requirements.

In an exemplary embodiment, the PIKAIA algorithm 40 and the MD are implemented as computer-executable code configured to be executed by a computer or the like. For example, the code can include FORTRAN, e.g. FORTRAN-77, FORTRAN-90, or the like. In order to integrate the genetic algorithm 122 with the APC 124, data must be passed onto each one in very specific formats. The integration framework 126 keeps track of all the algorithm control parameters, as well as the geometric configuration variables, and ensures they are properly parsed. The integration framework 126 also provides the necessary user feedback functions where the results of the evolutionary process are output in a usable format for post-processing.

Figure 6:
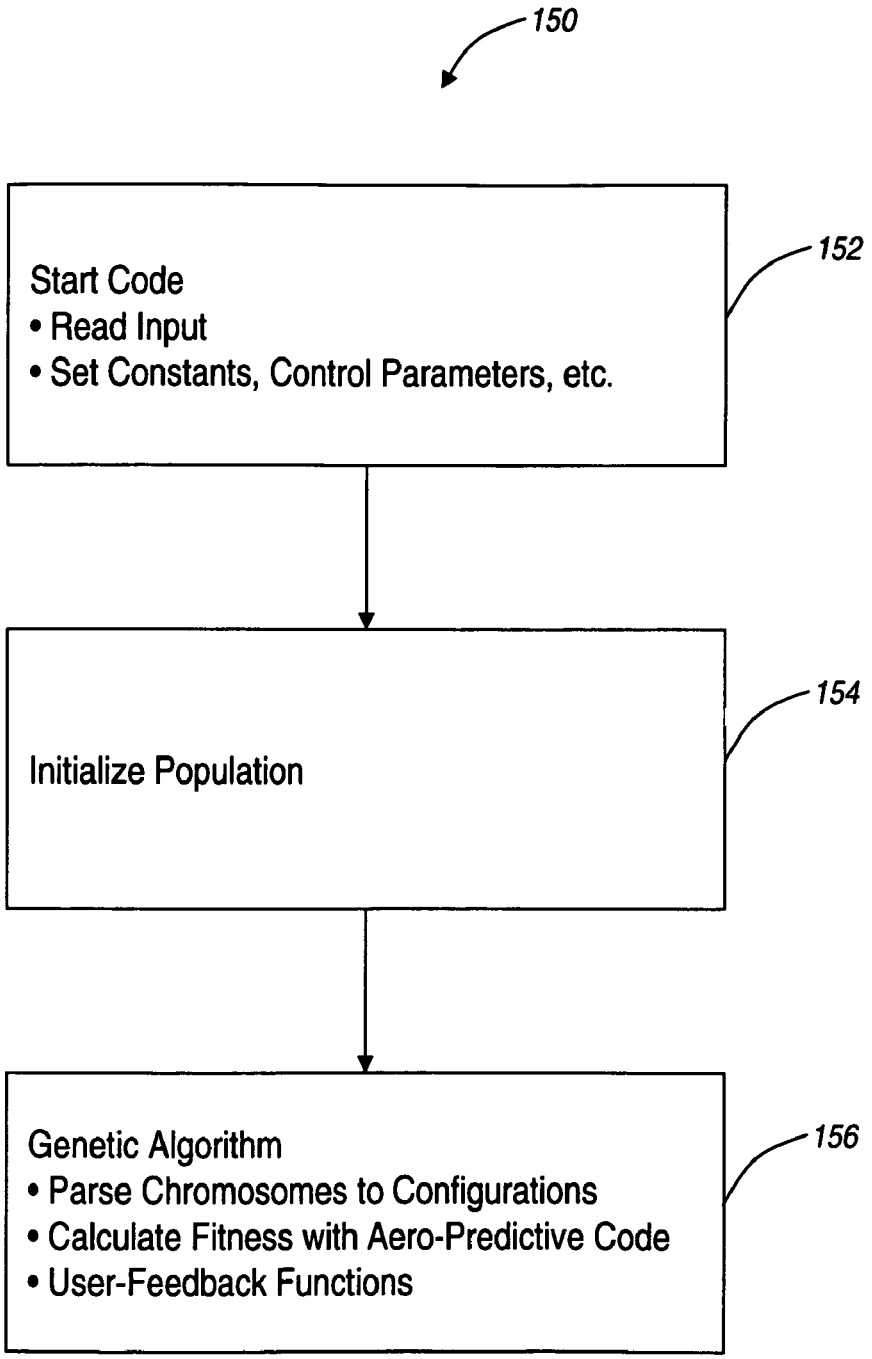
FIG. 6 illustrates a flowchart of a framework to tie the PIKAIA algorithm of FIG. 3 and an APC, such as the Missile Datcom (MD), together according to an exemplary embodiment of the present invention.

Referring to FIG. 6, a flowchart 150 illustrates the functionality of the integration framework 126 according to an exemplary embodiment of the present invention. These tasks include reading the input deck, passing the required algorithm control parameters and constants (step 152), and the development of the initial population (step 154). Additional functions are weaved into the original PIKAIA source code (as previously described) to provide the MD link and perform the output functions (step 156).

Generally, the integration framework 126 provides: 1. Data structure; 2. Inputs; 3. MD supported options; 4. Variable parsing; 5. Fitness calculation; and 6. Output. To facilitate the development of the input decks for MD (given how many variables could make up a single configuration), derived-type (TYPE) variables can be extensively used throughout. These give the programmer and user great flexibility in defining 'multi-tiered' variables consisting of numerous components. The individual components, themselves, can be of any type supported by FORTRAN. For example, the derived-type variables can include a type of nose, whether the nose is truncated or not, type of aft-body, a collection of real variables defining body geometry, and the like.

For the inputs, these provide parameters regarding the control and functionality of both the genetic algorithm and the aero-predictive code. The variables to be evolved through the genetic algorithm are also specified, along with appropriate bounds and any additional configuration variables that will remain constant throughout the evolution.

Collectively, the integration framework 126, the genetic algorithm 122, and the APC code 124 can use a vector array Control to associate several flags and parameters that control functionality. For example, the vector array Control can include twelve entries:

1. Population number [npop]: Defines the number of individuals in the population and is constant throughout the evolutionary process. It is internally restricted to npop≦300 due to constraints within the MD;

2. Number of generations [ngen]: Since the PIKAIA algorithm 40 does not keep track of the degree of convergence in the population (for objective completion purposes), the user must supply the maximum number of generations that will be evolved in the simulation;

11. Elitism [ielite]: This flag controls the option of enforcing elitism. A value of ielite=1 instructs PIKAIA algorithm 40 to enforce elitism, otherwise no action is taken. Elitism is applicable in both the FGR and SSDR plans. The SSDW plan implicitly makes use of this option; and 12. Verbose [verb]: The verb flag controls the amount of standard output provided as the simulation proceeds. With a value of verb=1, the PIKAIA algorithm 40 simply echoes the input parameters. Setting verb=2, index values for the best and average configurations in array oldph, fitness values for these configurations at each generation, current mutation rate, and the number of new offspring inserted in the population are all printed to screen. That is,

| Gener | BstIndx | AvgIndx | BestFit | AvgFit | MutRate | NewOff |
|---|---|---|---|---|---|---|
| 0 | 181 | 62 | 0.1561D+05 | 0.5365D+02 | 0.0050 | 200 |
| 1 | 149 | 131 | 0.3168D+06 | 0.1271D+03 | 0.0033 | 199 |

3. Encoding accuracy [ndg]: This parameter restricts the number of digits used during the encoding of the phenotype into a genotype and is internally restricted to six. This restriction is due to typical 32-bit floating point accuracy being only six to seven decimal places;

4. Crossover rate [pcross]: Defines the threshold value at which, if exceeded by a randomly generated number, two selected parents will be crossed;

5. Mutation mode [mut_proc]: Integer flag which defines which of the two mutation operators to use. A setting of mut_proc=1 specifies a constant mutation rate is to be used, at a value set in pmut (see below). For mut_proc=2, the dynamic mutation operator is enforced where the mutation rate is initialized to pmut and is allowed to vary between [pmutmn, pmutmx], depending on the degree of convergence;

6. Initial mutation rate [pmut]: This value represents the probability of a particular gene being affected by mutation upon breeding. If a randomly generated number does not exceed this value, the corresponding gene is mutated;

7. Minimum mutation rate [pmutmn]: If mut_proc=2, this value (pmutmn<<1) represents the minimum attainable mutation rate under the dynamic mutation scheme;

8. Maximum mutation rate [pmutmx]: Used only if mut_proc=2, this value specifies the maximum allowable mutation rate under the dynamic mutation scheme (must be much smaller than unity);

9. Fitness differential [fit_diff]: Parameter used in the ranking procedure to assign fitness. The PIKAIA algorithm 40 initially ranks individuals as [1, 2, . . . , npop], according to the calculated fitness and where the most fit individual has a rank of 1 and the least npop, respectively. The probability of breeding used is $$\frac{1}{npop} + \frac{\text{fit_diff}}{npop}\left(1 - \frac{2 * jfit(i)}{npop + 1}\right), \tag{12}$$

where jfit(i) is the rank of the individual, as described above;

10. Reproduction plan [repr]: This integer flag controls the choice of available reproduction plans. They are: full-generational replacement (repr=1) or steady-state reproduction (repr=2 for delete-random version, or repr=3 for delete worst);

The control vector and its components are summarized in Table 2, below.

| Element | Variable | Type | Legal Values |
|---|---|---|---|
| 1 | npop | Integer | ≦300 |
| 2 | ngen | Integer | ≦∞ |
| 3 | ndg | Integer | ≦6 |
| 4 | pcross | Real | 0.0 ≦ pcross ≦ 1.0 |
| 5 | mut_proc | Integer | 1, 2 |
| 6 | pmut | Real | 0.0 ≦ pmut ≦ 1.0 |
| 7 | pmutmn | Real | 0.0 ≦ pmutmn ≦ 1.0 |
| 8 | pmutmx | Real | 0.0 ≦ pmutmx ≦ 1.0 |
| 9 | fit_diff | Real | 0.0 ≦ fit_diff ≦ 1.0 |
| 10 | repr | Integer 1, 2, 3 | |
| 11 | ielite | Integer 0, 1 | |
| 12 | verb | Integer 1, 2 | |

Several other parameters need to be specified in the Genetic Algorithm Controls block. After the Control vector has been specified, the user will input a large integer value that will be used as the initial seed (variable seed) in the random-number-generating routine. Next, the present invention expects three inputs regarding the type of optimization to be conducted; these are the number of objectives (e.g. nobj=[1, 2]), whether the optimization will be conducted using engineering-level or high-fidelity data (e.g. opttyp=0 for engineering-level; 1 for high-fidelity), and the variable to be optimized (e.g. VtoOpt=[CNCA, XCP, BOTH]). It should be noted that a check is performed to verify that the input entry for the number of objectives (nobj) coincides with the amount of variables specified for optimization (VtoOpt). If this arrangement is not met, the present invention may issue a warning and give the user time to correct the input without having to kill the simulation.

The final two entries in the Genetic Algorithm Controls block correspond to the weights to be assigned to each of the independent variables, CNCA and XCP. These entries are relevant only if a multi-objective optimization is performed, otherwise, they are ignored.

The user can provide inputs to the APC code 124, such as inputs required to control Missile Datcom's functionality. In particular, these input can be organized as follows: 1. General controls: Unit System to be used (unsys=[IN, FT, CM, or M]); Derivative Units (derive=[RAD or DEG]); 2. Fin Geometry Controls: Number of (insets (nfins=[0 or 1]); Number of panels (npan=[1, 8]); and 3. Flight Condition Controls: Number of angles of attack (nalpha=[1, 20]); Minimum angle of attack (alph_min); Number of angle of attack increments (delaplha); Number of Mach (nmach=[1, 20]); Minimum Mach (mach_min); Number of Mach increments (delmach); and Altitude (alt).

The present invention may have the capability to vary twenty or more independent variables that control a configuration's geometry through the genetic algorithm 122. The user can choose to manipulate either all or a number of these parameters by providing the proper input in this section. The variable UseVar is a LOGICAL vector array used internally by the present invention to determine whether a variable will evolve throughout the simulation or whether a constant value will be assumed. All the user is required to enter is either a .TRUE. or .FALSE. entry to include the variable in the evolution or maintain it at a predetermined value, respectively.

For example, an exemplary lists of geometric parameters may include

| Element | Geometric Parameter |
|---|---|
| 1 | Nose Type? |
| 2 | Truncate Nose? |
| 3 | Aftbody Type |
| 4 | Nose Length |
| 5 | Nose Diameter |
| 6 | Centerbody Length |
| 7 | Centerbody Diameter |
| 8 | Aftbody Length |
| 9 | Aftbody Diameter |
| 10 | Nozzle Diameter |
| 11 | Fin Span—Station 1 |
| 12 | Fin Span—Station 2 |
| 13 | Fin Chord—Station 1 |
| 14 | Fin Chord—Station 2 |
| 15 | Fin XLE |
| 16 | Fin LE Sweep |
| 17 | Fin Thickness—Station 1 |
| 18 | Fin Thickness—Station 2 |
| 19 | Truncate Fin? |
| 20 | Blunt Nose? |

The Default Initial Configuration block is where the user can loft an initial configuration by defining all the required geometric variables. If any of the variables in the UseVar array are not used in the evolutionary process (see previous section), all the configurations evolved in the simulation will default to the corresponding value specified in this section.

This portion of the input deck is also split into several segments. The first segment provides a 'snapshot' of the overall configuration layout. Here, the initial nose type (nose=[OGIVE, CONE]) is defined, along with flags that specify whether the nose will be either pointed or truncated/blunted (truncate/bnose=[YES or NO]). A value of NO in both of these latter parameters specifies a pointed nose. The aftbody type follows the blunted entry (aftb=[NONE, CONIC, OGIVE]). The final entry in this segment specifies whether the fins will be forced to have a maximum span equal to the body's diameter (bdiamfin=[YES or NO]). This option has been provided in the event that the projectile is being designed to fit within a particular diameter (e.g. the inner diameter of a launcher).

The last three segments of the Default Initial Configuration block specify the numerical values for the parameters defining the initial nose, center- and aft-bodies, and fin sections. The constituent variables are: 1. Nose Section: length, diameter, and blunt radius; 2. Center- and Aft-Body Sections: center length, center diameter, aft length, and aft diameter; and 3. Fin Sections: span, chord, XLE (distance to fin leading edge), sweep, and thickness.

The final block in the input deck defines the bounds to be enforced for each variable being evolved. It is organized in a similar fashion to the final three segments of the Default Initial Configuration block: 1. Nose Section: min/max length, min/max diameter, and min/max blunt diameter; 2. Center- and Aft-Body Sections: min/max center length, min/max center diameter, min/max aft length, min/max aft diameter; and 3. Fin Sections: min/max span, min/max chord, min/max XLE, min/max sweep, and min/max thickness. As before, these values must be entered in the unit system specified previously.

Numerous output functions have been built into the present invention to provide the user with as much feedback as possible throughout the evolutionary simulation. The approach used to quantify how the population evolves from generation-to-generation is to track the fitness of both the best and average individuals within the population. That is, at each generation, data for the best and average configurations (identified as those residing in indices npop and npop/2 of the ifit array) is output to both, screen and file. The screen output can include the fitness values of both of these individuals.

The main output can include three data files. These correspond to a file which collects the explicit Datcom input (GenBestConfigs.dat) of the best individual in each generation and another that collects the same data for the average configurations (GenAvgConfigs.dat). The remaining file (GenFitness.dat) contains the fitness values for both the best and average configurations and is organized in a format suitable for input to Tecplot, a post-processing software package.

Its simplicity and flexibility are two important factors that allowed quick implementation. The version of PIKAIA described herein is slightly different than the open source one; here, the original source has been modified to handle the fitness function of interest and the required data structures. A user can supply several parameters defining a missile system's geometric configuration, along with ranges for each, to define the desired design space. The present invention then evolves a population of suitable solutions (i.e. configurations) until a design that best fulfills the user-supplied target objective is isolated.

As described herein, the present invention is the computational framework designed to tie a genetic algorithm (GA) to an aero-predictive code (APC). It can be written in FORTRAN-90 for Windows and can make extensive use of MODULEs. In order for either the GA or APC to perform their objective task, data must be passed onto each one in very specific formats. The present invention keeps track of all the algorithm control parameters, as well as the geometric configuration variables, and ensures the latter are properly parsed between the individual software components. The code also provides the necessary user feedback functions where the results of the evolutionary optimization process are output in a usable format for post-processing.

The present invention includes the framework of the required functions that need to be performed to initialize the GA. First, the user-supplied inputs are collected. These inputs include the necessary control settings for the optimization procedure and the bounds for all the variables to be evolved. Examples of these inputs include the projectile geometry and variables defining the operational envelope. Once the inputs are read, an initial population of candidate solutions is randomly generated. Each individual solution's aerodynamic performance is analyzed by the APC and the results are passed onto the GA, which uses these so-called fitness values to rank the population and breed a new one by crossing individuals. This procedure is repeated until a set number of populations (generations) have been bred. Throughout the evolutionary process, the present invention continuously provides feedback on the degree of fitness of the best-performing individuals. This data is saved onto output files for future inspection by the user.

The present invention takes advantage of the automation of genetic algorithms. If a suitable performance measure can be identified and provided to the GA, it can learn the complex interactions between all the parameters of interest to reach an end solution. This solution is one solution, which provides the maximum performance within the input requirements. A process that could take days, weeks, or even months can be condensed into a matter of minutes or hours without loss of generality or applicability.

Figure 7:
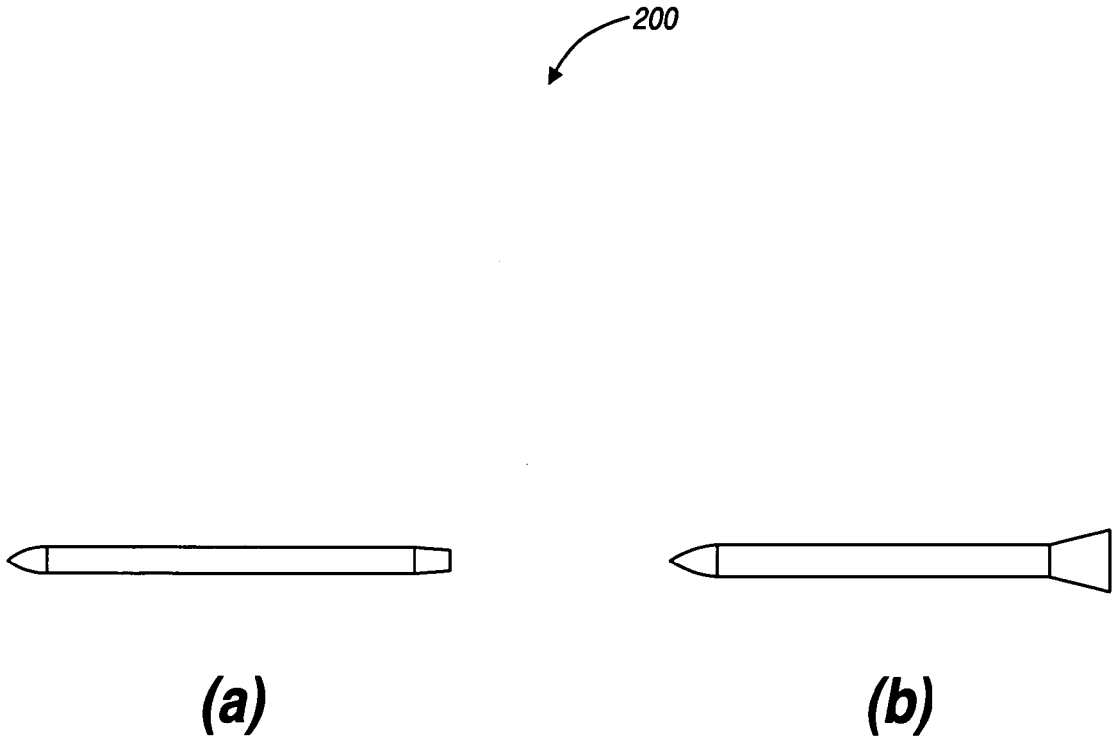
FIG. 7 illustrates a design space for an individual objective function test with minimum and maximum dimensions according to an exemplary embodiment of the present invention.

Referring to FIG. 7, a design space 200 is illustrated for an individual objective function test with minimum and maximum dimensions according to an exemplary embodiment of the present invention. For the evaluation of the different objective functions, a simple projectile configuration is chosen which includes an axisymmetric, ogive nose, a cylindrical center body, and a boattail/flare. The variables that are used in the evolution are the nose length and diameter, body length, and aftbody length and diameter. Therefore, the variables for a genetic algorithm Input block in the are:

```
Nose_Type: .FALSE.
Aft_Type: .FALSE.
Nose_Diam: .TRUE.
Centr_Diam: .TRUE. (or .FALSE.)
Aft_Diam: .TRUE.
Span_l: .FALSE.
Chord_1: .FALSE.
XLE_1: .FALSE.
Thick_1: .FALSE.
Trunc_Fin: .FALSE.
Nose_Type: .FALSE.
Aft_Type: .FALSE.
Nose_Diam: .TRUE.
Centr_Diam: .TRUE. (or .FALSE.)
Aft_Diam: .TRUE.
Span_l: .FALSE.
Chord_1: .FALSE.
XLE_1: .FALSE.
Thick_1: .FALSE.
Trunc_Fin: .FALSE.
```

FIG. 7 illustrates the minimum dimensions (FIG. 7(*a*)) and the maximum dimensions (FIG. 7(*b*)). The variable bounds (design space) for individual objective function tests include:

| Geometric Parameter | Variable Bounds |
|---|---|
| Nose Length | $0.5 \leqq Ln \leqq 1.5$ |
| Nose Diameter | $0.4 \leqq Dn \leqq 1.0$ |
| Centerbody Length | $5.0 \leqq Lcb \leqq 10.0$ |
| Aftbody Length | $0.5 \leqq Lab \leqq 2.0$ |
| Aftbody Diameter | $0.25 \leqq Dab \leqq 2.0$ |

Fitness values are summed over seven, low subsonic Mach numbers and thirteen angles of attack. The Mach numbers are 0.025, 0.075, 0.100, 0.125, 0.150, and 0.175 while the angles of attack are varied between −60° and 60° in 10° increments. The control parameters for the GA are summarized the Table below. For all of the simulations in this section, the full generational replacement reproduction plan with elitism is used to evolve the population.

| GA Control Parameter | Value |
|---|---|
| Population Size | 30 |
| Number of Generations70 | |
| Significant Digits | 4 |
| Crossover Probability | 0.85 |
| Mutation Mode | Dynamic |
| Initial Mutation Rate | mut_proc = 2 |
| Min Mutation Rate | 0.005 |
| Max Mutation Rate | 0.0005 |
| Fitness Differential 0.25 | |
| Reproduction Plan | 0.9 |
| Elitism | Full Generational Replacement |
| Verbose | repr = 1 |

In working with missiles and projectiles, the adoption of a body-fitted coordinate system (normal/axial) to report forces is often favored over a global reference frame (lift/drag). For this reason, the aerodynamic measure of efficiency is set as the ratio of normal-to-axial forces (in coefficient form) in the present invention. Therefore, the aim of the optimization is to generate a configuration, which generates the largest possible normal force and the least amount of axial force within the geometric bounds.

For projectiles such as those shown in FIG. 7, there are certain trends that can be expected when attempting to optimize the aerodynamics. Since no fins or wing structures are employed, there are several possibilities for maximizing the normal force. First, a projectile nose generates larger normal forces as its length increases. The projectile's body also generates higher normal forces the larger its diameter becomes. Aftbodies can also contribute a considerable amount of normal force with varying diameter, particularly with the large length-to-diameter (L/D) of the configurations in FIG. 7.

Figure 8:
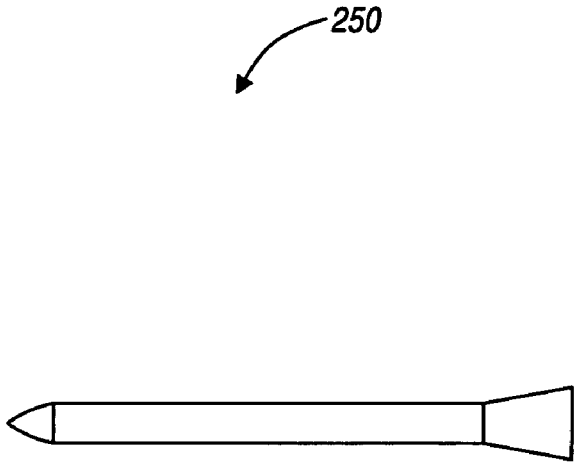
FIG. 8 illustrates a result of an aerodynamic optimization along with a table showing numerical data according to an exemplary embodiment of the present invention.

Referring to FIG. 8, a result 250 of an aerodynamic optimization is illustrated along with a table showing numerical data according to an exemplary embodiment of the present invention. As predicted, the optimized projectile nose length is on the high-side of the variable bounds and the body (and nose) diameter is close to the maximum value. Note that the optimized configuration makes use of a flare, instead of the boattail. Even though higher base drag is generated with such a design (compared to a boattail design), the increased surface area provides sufficient normal force to outweigh the associated drag, or axial force, penalty.

Figure 9:
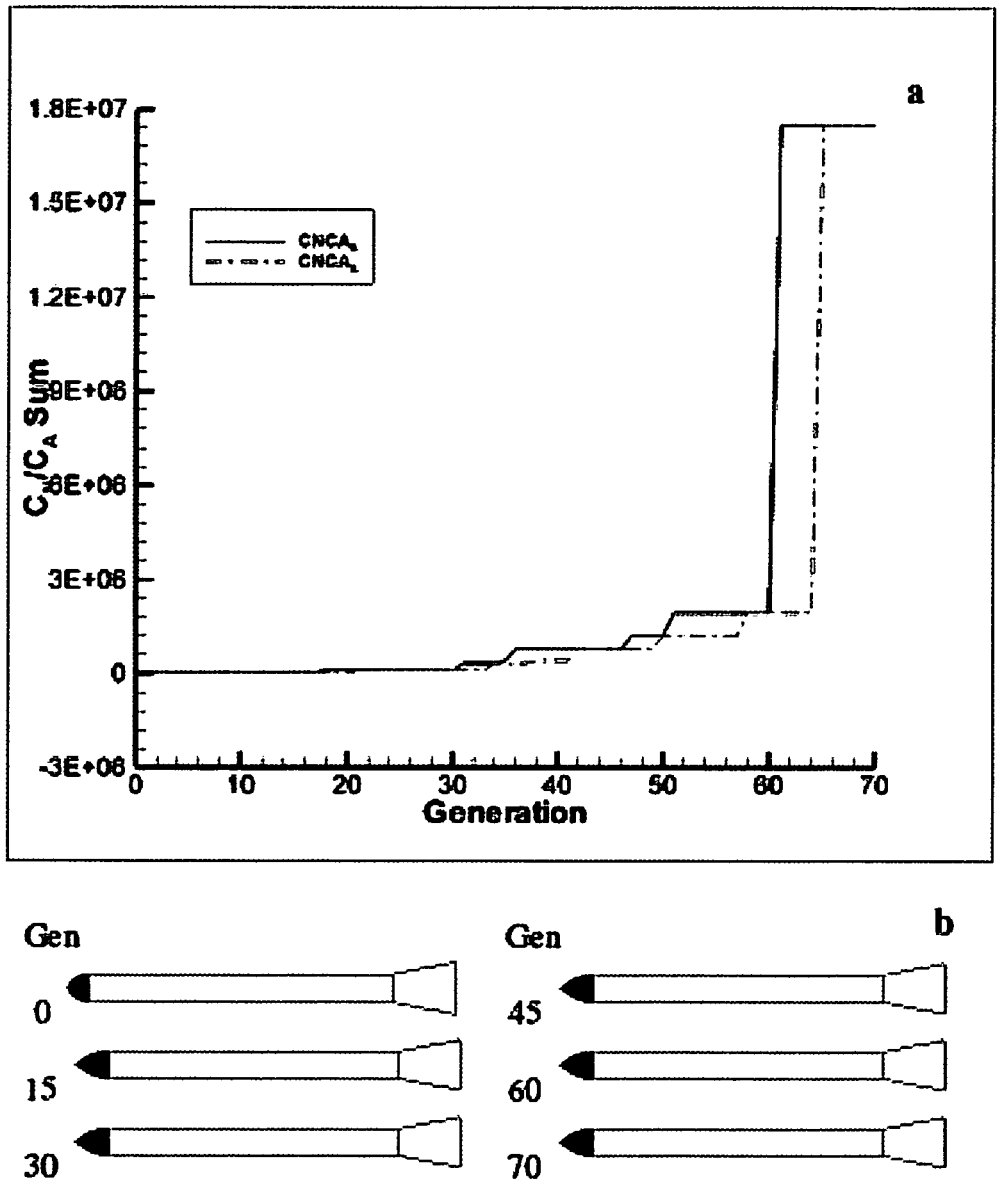
FIG. 9 illustrates an evolution of the configuration plotted out as fitness value curves (FIG. 9*a*) and external shape histories (FIG. 9*b*) to illustrate the outputs according to an exemplary embodiment of the present invention.

Referring to FIG. 9, an evolution of the configuration is plotted out as fitness value curves (FIG. 9*a*) and external shape histories (FIG. 9*b*) to illustrate the outputs according to an exemplary embodiment of the present invention. The solid curve in FIG. 9*a* corresponds to the fitness value of the best performing individual in each generation while the dash-dotted line shows the average configuration's fitness evolution. It is important to note the step-wise manner in which the best configuration's fitness proceeds. This configuration is explained by the use of elitism, which preserves the best configuration until a more fit one is bred. Also, the largest increments in fitness for the best configuration occur when the average performer in the population catches up. When this event occurs, PIKAIA enforces a higher mutation rate, which can aid pushing the evolution past a possible 'local' maximum. This action is evident in the last increment taken by the best configuration around the sixtieth generation.

Another interesting point to note is that even minor changes on a single variable can have much larger effects on the overall design's efficiency. For example, the changes that increase the best configuration's overall fitness by such a large amount are so small that they are not very discernable in the external shapes plotted in FIG. 9*b*.

There is an important difference between the aerodynamic and stability objectives built into the present invention. There are no limits imposed on how aerodynamically efficient the optimized projectile is because there are no adverse effects generated by efficient aerodynamics. However, if a platform is too stable, the slightest disturbance can veer it off-course as it attempts to align itself in the direction of the disturbance. At the other end of the spectrum, the platform will not be able to fly at all if it is not stable enough. A careful balance, therefore, needs to be achieved when considering projectile stability and for this reason the optimization function for stability is based on Eq. 11 with a target static margin, $X_{cp\text{-}tar}$.

Using the same design space as in FIG. 7 and adopting a static margin of 1.5 (in calibers), the simulation was rerun to identify the design that best meets the stability objective within the parameter bounds. That is, the best design will have its center of pressure located 1.5 calibers behind its center of gravity.

Because of the large L/D ratio of the desired configuration and the relatively small value of static margin, the optimized design is expected to have a very shallow flare. The distance between the flare center of pressure and the moment reference point (center of gravity) is large enough that only a small normal force contribution from the stabilizing surface is required. For this reason, the final design cannot have a boattail. As compared to the aerodynamically optimized projectile, this design is expected to have smaller dimensions for all of the components.

Figure 10:
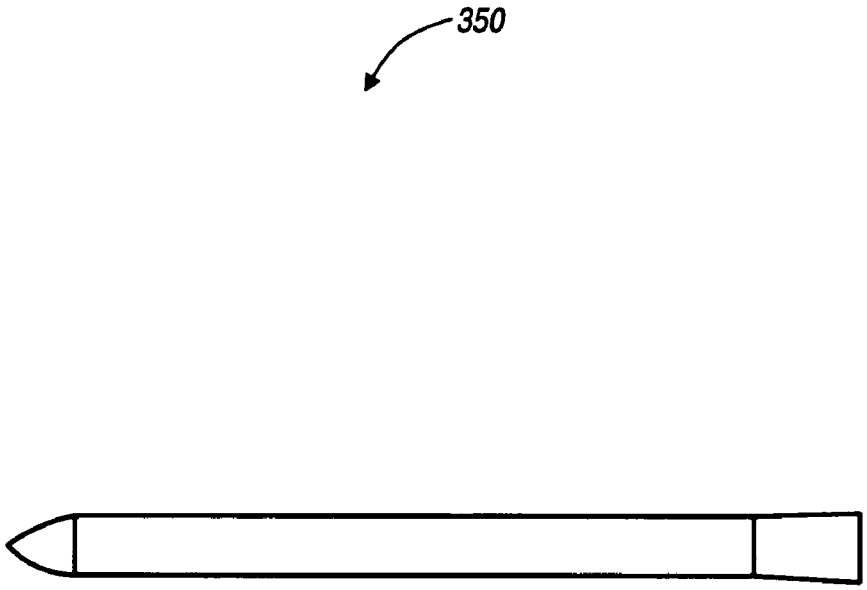
FIG. 10 illustrates a stability-optimized projectile along with a table according to an exemplary embodiment of the present invention.

Referring to FIG. 10, a stability-optimized projectile 350 is illustrated along with a table according to an exemplary embodiment of the present invention. The projectile 350 confirms the expected trends of smaller dimensions throughout. Nose, body, and flare lengths are 27, 9, and 36 percent reduced when compared to the previous test case, respectively. Nose/body and aftbody diameters are also 14 and 46 percent smaller, respectively.

Referring to FIG. 11, FIG. 11*a* represent the fitness values of the best and average configurations of each generation and FIG. 11*b* represents external shapes according to an exemplary embodiment of the present invention. This particular example shows the variability in mutation rate better than the previous one. Here, few large increments are evident in the best configurations' curve, allowing ample generations for the rest of the population to catch up. Since this signals a high degree of convergence, PIKAIA increases the mutation rate significantly and alters a good portion of the population (evident by the large drop in the average curve). This pattern is repeated multiple times because of the infrequent instances where the best configuration is replaced by a more fit one.

Figure 12:
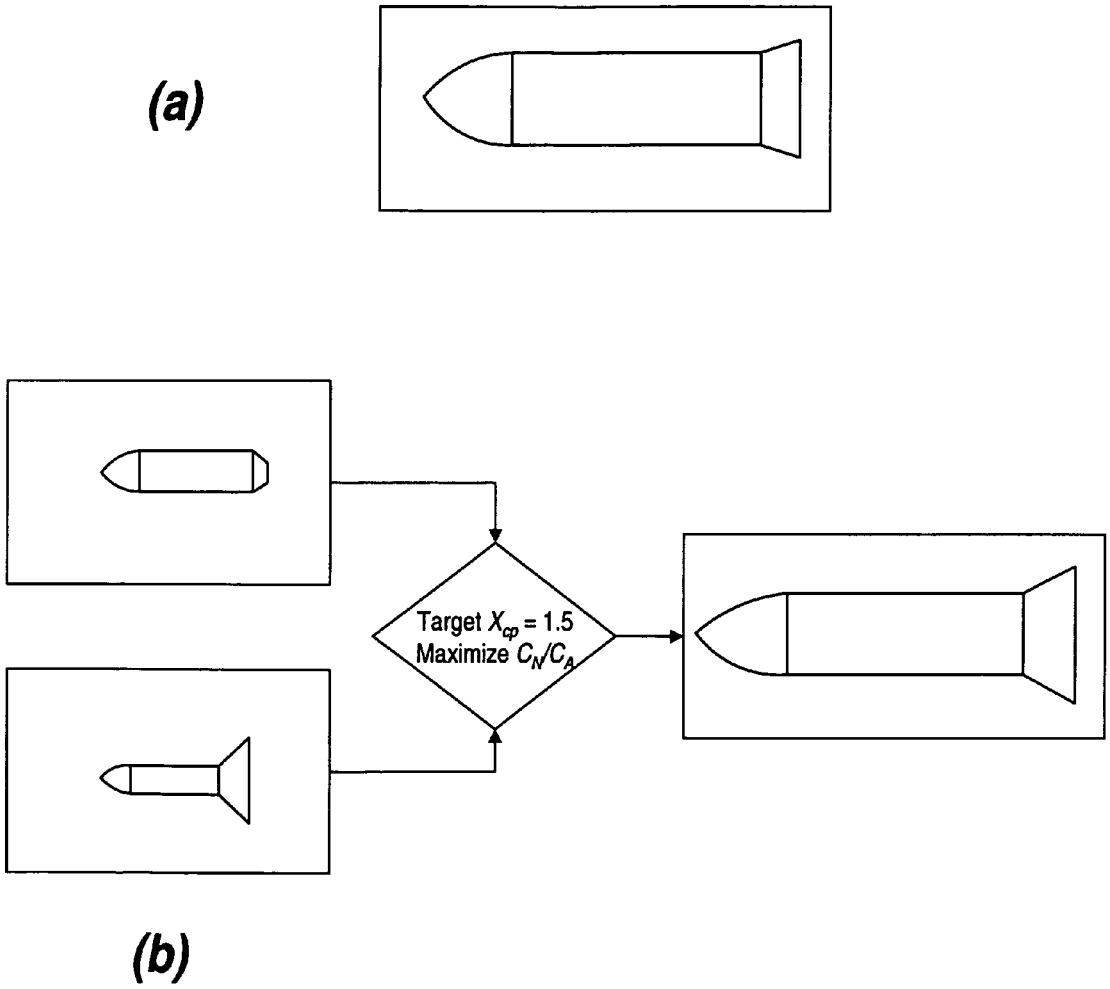
FIG. 12 illustrates a practical example as a first test of the multi-objective functionality incorporated according to an exemplary embodiment of the present invention.

Referring to FIG. 12, a more practical example is illustrated as a first test of the multi-objective functionality incorporated according to an exemplary embodiment of the present invention. Assume that the projectile shown in FIG. 12*a* has been designed to meet certain program requirements without using the optimizer. After having completed the design, changes in the program have brought about extensive modifications to the requirements and a new projectile must be lofted. The new design, however, will only require modifications to its dimensions; the overall shape can remain the same.

Since both aerodynamic efficiency and stability considerations are of paramount importance (the projectile must meet a particular range requirement and must accurately strike a target), a multi-objective optimization is performed to identify possible solutions within the new geometric constraints. The user decides some aerodynamic efficiency can be traded for added stability; therefore, he assigns larger weights to the stability objective and runs the optimizer.

This procedure is illustrated in FIG. 12*b*, where the variable bounds are pictured on the left, optimization objectives are specified in the diamond, and the output configuration is pictured on the right. After performing the optimization, the new projectile maintained the same body diameter while increasing the nose, centerbody and aftbody lengths as well as the aftbody diameter.

Figure 13A:
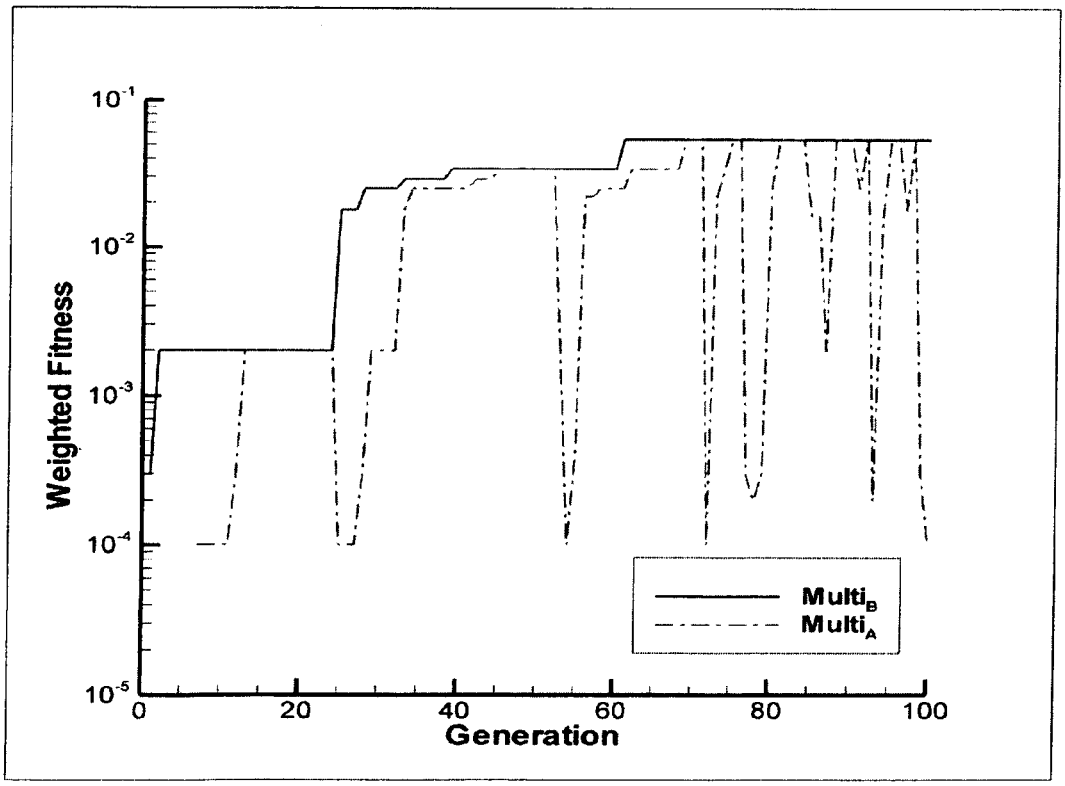
FIG. 13 illustrates results from FIG. 12 according to an exemplary embodiment of the present invention.
Figure 13B:
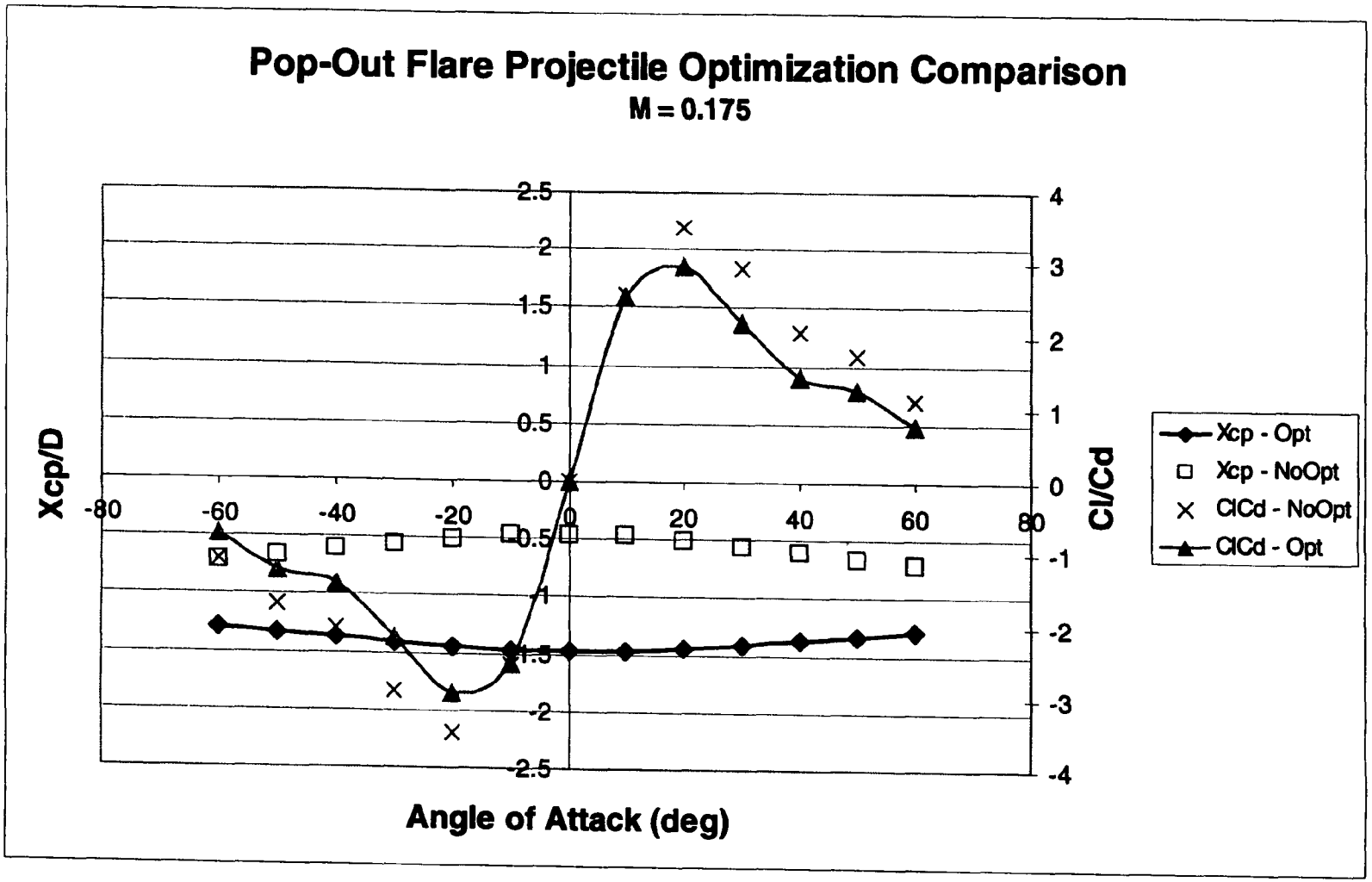

Referring to FIG. 13, these results can be seen in the illustrated table, where the data is in units of cm along with a plot of the fitness values according to an exemplary embodiment of the present invention. Here, the user should note the use of the scaled overall fitness value and the similar behavior of the average configurations' curve as previously described.

To confirm that indeed this new design is better than the original, the performance of the two is plotted in the bottom graph in FIG. 13 at Mach of 0.175. Immediately evident is the code's ability to develop a design that meets the stability requirement, as the static margin increased by about a full body diameter throughout the angle of attack range. Naturally, the larger flare generates higher drag force than the original but was deemed acceptable.

Some portions of the detailed descriptions which follow are presented in terms of procedures, logic blocks, processing, steps, and other symbolic representations of operations on data bits within a computer memory. These descriptions and representations are the means used by those skilled in the data processing arts to most effectively convey the substance of their work to others skilled in the art. A procedure, logic block, process, etc., is generally conceived to be a self-consistent sequence of steps or instructions leading to a desired result. The steps require physical manipulations of physical quantities. Usually, though not necessarily, these quantities take the form of electrical or magnetic signals capable of being stored, transferred, combined, compared and otherwise manipulated in a computer system. It has proven convenient at times, principally for reasons of common usage, to refer to these signals as bits, bytes, words, values, elements, symbols, characters, terms, numbers, or the like.

It should be born in mind that all of the above and similar terms are to be associated with the appropriate physical quantities they represent and are merely convenient labels applied to these quantities. Unless specifically stated otherwise as apparent from the following discussions, it is appreciated that throughout the present invention, discussions utilizing terms such as 'processing,' 'computing,' 'calculating,' 'determining,' 'displaying' or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The invention can take the form of an entirely hardware embodiment, an entirely software embodiment or an embodiment containing a combination of hardware and software elements. In an exemplary embodiment, a portion of the mechanism of the invention is implemented in software, which includes but is not limited to firmware, resident software, object code, assembly code, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium is any apparatus that can contain, store, communicate, propagate, or transport the program for use by or in connection with the instruction execution system, apparatus, or device, e.g., floppy disks, removable hard drives, computer files comprising source code or object code, flash semiconductor memory (USB flash drives, etc.), ROM, EPROM, or other semiconductor memory devices.

Although the present invention has been illustrated and described herein with reference to exemplary embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A system for optimizing aerodynamic configurations, comprising:

at least one processor coupled to a memory, wherein said at least one processor is configured to execute a genetic algorithm-based optimizing routine, an aeropredictive code, and an integration framework to connect the genetic algorithm-based optimizing routine with the aeropredictive code, and wherein the genetic algorithm-based optimizing routine is configured to define overall aerodynamic geometry and performance measures of a device responsive to user-defined criteria.

2. The system of claim 1, wherein the genetic algorithm-based optimizing routine comprises the PIKAIA algorithm and wherein the aeropredictive code comprises Missile Datcom.

3. The system of claim 1, wherein the integration framework comprises data structure, inputs, supported options for the aeropredictive code, variable parsing, fitness calculation, and outputs.

4. The system of claim 3, wherein the integration framework comprises data structure, inputs, supported options for the aeropredictive code, variable parsing, fitness calculation, and outputs.

5. The system of claim 3, wherein the integration framework comprises data structure, inputs, supported options for the aeropredictive code, variable parsing, fitness calculation, and outputs, wherein the integration framework comprises control variables operable to control functionality of the genetic algorithm-based optimizing routine and the aeropredictive code; and wherein the control variables comprise any of population number, number of generations, encoding accuracy, crossover rate, mutation mode, initial mutation rate, minimum mutation rate, maximum mutation rate, fitness differential, reproduction plan, elitism, verbosity, and initial seed.

6. The system of claim 1, wherein the genetic algorithm-based optimizing routine is configured to evolve a plurality of variables associated with the device's geometry.

7. The system of claim 6, wherein the plurality of variables comprise any of nose type, truncated nose, aftbody type, nose length, nose diameter, centerbody length, centerbody diameter, aftbody length, nozzle diameter, fin span, fin chord, fin thickness, truncated fin, and blunt nose.

8. The system of claim 1, wherein the genetic algorithm-based optimizing routine comprises a multi-objective optimization scheme based on weighted sums.

9. The system of claim 1, wherein the genetic algorithm-based optimizing routine comprises a roulette wheel selection algorithm for breeding.

10. A method for utilizing a genetic algorithm with an aeropredictive code, comprising:

receiving a set of constraints and control parameters;

initializing a population;

utilizing a genetic algorithm to parse chromosomes responsive to the set of constraints and control parameters; and calculating fitness with an aeropredictive code.

11. The method of claim 10, wherein the genetic algorithm comprises the PIKAIA algorithm and wherein the aeropredictive code comprises Missile Datcom.

12. The method of claim 10, further comprising integrating the genetic algorithm with the aeropredictive code.

13. The method of claim 12, wherein the set of constraints and control parameters comprises control variables operable to control functionality of the genetic algorithm and the aeropredictive code, and wherein the control variables comprise any of population number, number of generations, encoding accuracy, crossover rate, mutation mode, initial mutation rate, minimum mutation rate, maximum mutation rate, fitness differential, reproduction plan, elitism, verbosity, and initial seed.

14. The method of claim 10, wherein the genetic algorithm is configured to evolve a plurality of variables associated with a device's geometry.

15. The method of claim 14, wherein the plurality of variables comprise any of nose type, truncated nose, aftbody type, nose length, nose diameter, centerbody length, centerbody diameter, aftbody length, nozzle diameter, fin span, fin chord, fin thickness, truncated fin, and blunt nose.

16. The method of claim 10, wherein the genetic algorithm comprises a multi objective optimization scheme based on weighted sums.

17. A system for integrating a genetic algorithm with an aeropredictive code, comprising:

a computer configured to execute:

a PIKAIA algorithm;

an aeropredictive code; and an integration framework to connect the PIKAIA algorithm with the aeropredictive code, wherein the PIKAIA algorithm is configured to define overall aerodynamic geometry and performance measures of a device responsive to user-defined criteria.

18. The system of claim 17, wherein the PIKAIA algorithm is configured to evolve a plurality of variables associated with the device's geometry, and wherein the plurality of variables comprise any of nose type, truncated nose, aftbody type, nose length, nose diameter, centerbody length, centerbody diameter, aftbody length, nozzle diameter, fin span, fin chord, fin thickness, truncated fin, and blunt nose.

19. The system of claim 17, wherein the genetic algorithm-based optimizing routine comprises a multi-objective optimization scheme based on weighted sums.

20. The system of claim 17, wherein the genetic algorithm-based optimizing routine comprises a roulette wheel selection algorithm for breeding.

21. A system for optimizing a configuration, comprising:

at least one processor being coupled to a memory, wherein said at least one processor is configured to execute a genetic algorithm-based optimizing routine, a predictive code; and an integration framework to connect the genetic algorithm-based optimizing routine with the predictive code, and wherein the genetic algorithm-based optimizing routine is configured to define overall performance measures of an article responsive to user-defined criteria.

* * * * *